US011655112B2

(12) United States Patent
Maeda et al.

(10) Patent No.: US 11,655,112 B2
(45) Date of Patent: May 23, 2023

(54) MEDIUM REGULATING COMPONENT, MEDIUM FEEDING DEVICE, AND MEDIUM PROCESSING APPARATUS USING THE SAME

(71) Applicant: FUJIFILM BUSINESS INNOVATION CORP., Tokyo (JP)

(72) Inventors: Shoichi Maeda, Kanagawa (JP); Teruki Naganuma, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 176 days.

(21) Appl. No.: 17/150,264

(22) Filed: Jan. 15, 2021

(65) Prior Publication Data

US 2022/0081241 A1 Mar. 17, 2022

(30) Foreign Application Priority Data

Sep. 13, 2020 (JP) ..... JP2020-153403

(51) Int. Cl.
*B65H 3/56* (2006.01)
*B65H 3/48* (2006.01)

(52) U.S. Cl.
CPC ..... *B65H 3/56* (2013.01); *B65H 3/48* (2013.01); *B65H 2404/722* (2013.01); *B65H 2405/11425* (2013.01); *B65H 2406/11* (2013.01)

(58) Field of Classification Search
CPC ..... B65H 3/54; B65H 3/56; B65H 2405/11425
See application file for complete search history.

(56) References Cited

U.S. PATENT DOCUMENTS 9,725,265 B2 * 8/2017 Hashimoto ..... B65H 1/14
11,124,375 B2 * 9/2021 Matsuoka ..... B65H 1/266
2016/0016740 A1 1/2016 Niikura et al.

FOREIGN PATENT DOCUMENTS

JP 3653502 B2 5/2005
JP 2016-000653 A 1/2016

* cited by examiner

*Primary Examiner* — Patrick Cicchino
(74) *Attorney, Agent, or Firm* — Oliff PLC

(57) ABSTRACT

A medium regulating component for use in a medium feeding device feeding sheet media accommodated in an accommodating unit, the component for regulating excessive floating of a medium accommodated in the accommodating unit, the component includes: a regulating member protruding in a horizontal direction from an accommodating unit periphery and contacting the floating medium; a holding member holding the regulating member in a non-contact state with the medium; a first rotating shaft rotatably supporting the regulating member relative to the holding member; and a second rotating shaft rotatably supporting the holding member relative to the accommodating unit, in which when the regulating member receives a pressing force from below in a gravitational direction, rotates about the first rotating shaft in a state where movement of the holding member is suppressed, and pushes the holding member to rotate about the second rotating shaft.

20 Claims, 18 Drawing Sheets

MEDIUM REGULATING COMPONENT, MEDIUM FEEDING DEVICE, AND MEDIUM PROCESSING APPARATUS USING THE SAME

CROSS-REFERENCE TO RELATED APPLICATIONS

This application is based on and claims priority under 35 USC 119 from Japanese Patent Application No. 2020-153403 filed Sep. 13, 2020.

BACKGROUND

(i) Technical Field

The present disclosure relates to a medium regulating component, and a medium feeding device and a medium processing apparatus using the medium regulating component.

(ii) Related Art

JP-A-2016-000653 (see the detailed description and FIG. 17) discloses that a tray bottom plate of a sheet feeing tray extends such that a long size sheet can be loaded thereon, air is blown from the side of the sheet-feeding tray to levitate a sheet, and the levitated sheet is adsorbed to a transport belt and delivered.

JP-B-3653502 (the detailed description, [0017], [0018], and FIG. 2) discloses an air sheet feeding apparatus including a levitating separating unit that blows air to the front surface of a sheet accommodated in a sheet accommodating portion to levitate the upper layer sheet and separate the uppermost layer sheet from the sheet below, an suction transport unit on the upper sheet side of the sheet accommodating portion that sucks the uppermost sheet and transports it to a sheet transport portion, and a holding member that presses downward the center of the rear portion of the uppermost sheet accommodated in the accommodating portion.

SUMMARY

Aspects of non-limiting embodiments of the present disclosure relate to a medium regulating component that, in regulating excessive floating of a medium accommodated in an accommodating unit, easily rotates and retracts to both an upper side and a lower side, and is capable of stabilizing an initial position for medium regulation.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium regulating component for use in a medium feeding device that feeds sheet media accommodated in an accommodating unit, the medium regulating component for regulating excessive floating of a medium accommodated in the accommodating unit, the medium regulating component including: a regulating member that protrudes in a horizontal direction from a periphery of the accommodating unit and that comes into contact with the floating medium; a holding member that holds the regulating member in a non-contact state with the medium; a first rotating shaft that supports the regulating member to be rotatable with respect to the holding member; and a second rotating shaft that supports the holding member to be rotatable with respect to the accommodating unit, in which when the regulating member receives a pressing force from below in a gravitational direction, the regulating member rotates about the first rotating shaft in a state where movement of the holding member is suppressed, and when the regulating member receives a pressing force from above in the gravitational direction, the regulating member pushes the holding member to rotate about the second rotating shaft.

BRIEF DESCRIPTION OF THE DRAWINGS

Exemplary embodiment(s) of the present disclosure will be described in detail based on the following figures, wherein.

DETAILED DESCRIPTION

Outline of Exemplary Embodiment

Figure 1A:
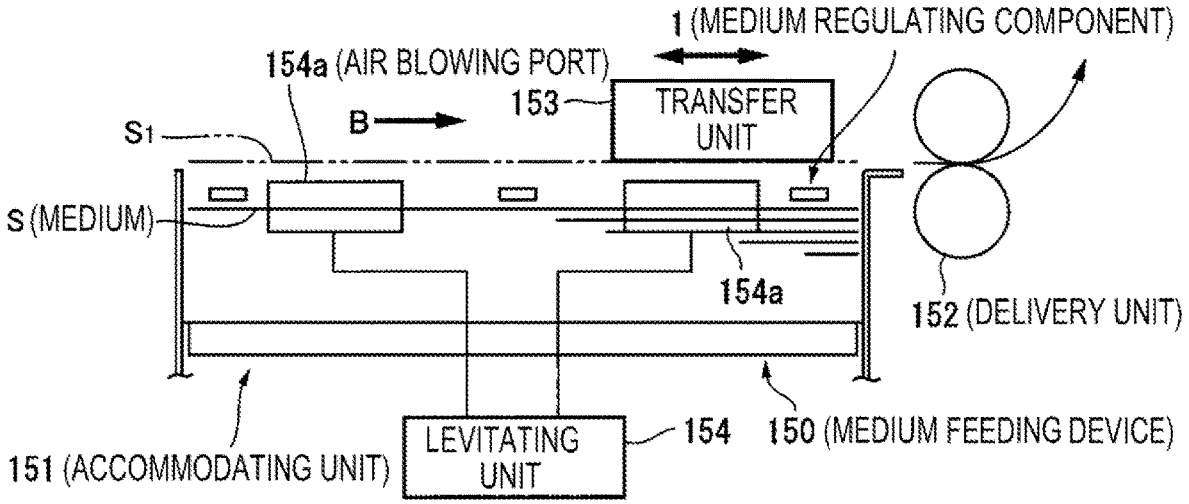
FIG. 1A is an explanatory view illustrating an outline of an exemplary embodiment of a medium feeding device to which the present disclosure is applied.

FIG. 1A is an explanatory view illustrating an outline of an exemplary embodiment of a medium feeding device to which the present disclosure is applied.

A medium feeding device 150 illustrated in the drawing feeds sheet media S one by one, and in addition to a case where the medium feeding device 150 is used alone, is implemented as a medium processing apparatus by, for example, using in combination with a processing unit (not illustrated in FIGS. 1A to 1C) that performs predetermined processing on the fed medium S. The processing unit stated here includes any units such as an image forming unit that forms an image on the medium or a coating unit that coats the medium.

In the example, as illustrated in FIG. 1A, the medium feeding device 150 includes an accommodating unit 151 in which the sheet media S are accommodated, a delivery unit 152 that is provided on a delivery direction side of the media S accommodated in the accommodating unit 151 and delivers the media S one by one, a transfer unit 153 that is provided above the accommodating unit 151 and transfers the medium S accommodated in the accommodating unit 151 to the delivery unit 152, and a medium regulating component 1 that is provided on the periphery of the accommodating unit 151 and regulates excessive floating of the accommodated medium S.

In such technical units, the accommodating unit 151 generally includes a loading portion on which the media S are loaded. Further, in an example in which the media S of various sizes are accommodated, a side guide portion and a rear guide portion are provided. The side guide portion guides the media S on the side intersecting a delivery direction of the media S. The rear guide portion guides the media S at the rear positioned on the side opposite to the delivery direction of the media S. Further, from the viewpoint of enabling the media S to be replenished, the accommodating unit 151 is often drawable with respect to a medium feeding device case.

Further, the delivery unit 152 broadly includes units having a function of delivering the medium S, but, for example, a paired delivery roller, a combination of a delivery roller and a delivery belt, or the like is typical. In this case, a function of nipping and delivering a medium S1 that is a delivery target in the nip area between the paired delivery members may be implemented. For example, when the delivery unit 152 is a pair of rollers, the medium S1 may be nipped in an area (nip area) where the pair of rollers is in contact with each other, and, additionally, one roller may transports a belt, and the pair of rollers may sandwich the belt.

Further, in the example, the transfer unit 153 broadly includes a unit that is provided above the accommodating unit 151 to receive the medium S accommodated in the accommodating unit 151 from the above, and transfers it to the delivery unit 152.

Figure 1B:
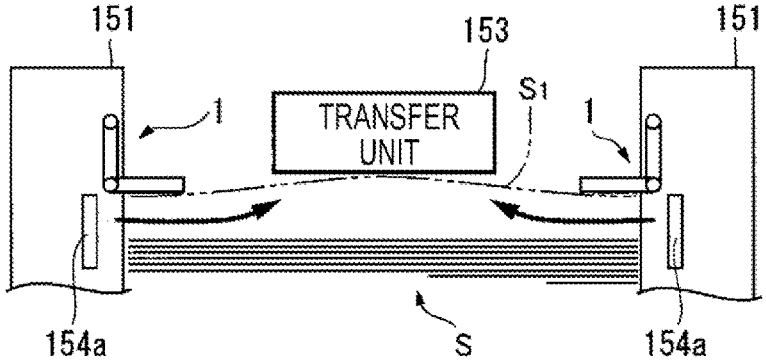
FIG. 1B is an explanatory cross-sectional view of the medium feeding device illustrated in FIG. 1A as viewed from the B direction.

Particularly, in an example in which the accommodating unit 151 accommodates a large number of media S or a long size media, as illustrated in FIGS. 1A and 1B, a levitating unit 154 may be provided on the side intersecting the delivery direction of the media S accommodated in the accommodating unit 151. The levitating unit 154 may blow air to the side of the media to levitate the media in a state where the upper area of the medium S is separated. The transfer unit 153 may adsorb the medium S1 levitated by the levitating unit 154 and transfers it to the delivery unit 152.

The reference numeral 154*a* in FIGS. 1A and 1B indicates an air blowing port provided in the accommodating unit 151.

Further, in the example, the media S accommodated in the accommodating unit 151 is transferred from the transfer unit 153 positioned above the accommodating unit 151 to the delivery unit 152. However, the medium S1 that is the delivery target is required to be separated from the media S positioned below the medium S1, and is usually transferred to the transfer unit 153 in a floating state.

Particularly, in an example in which the levitating unit 154 is provided, as illustrated in FIG. 1B, the floating force of the medium S is further increased by acting the levitating force by the air, and the medium S is likely to excessively float. In this case, when the transfer unit 153 receives the medium S1 in the excessive floating state, the transfer posture of the medium S1 by the transfer unit 153 is collapsed, and the medium may be transferred to the delivery unit 152 in a greatly skewed state.

As a result, in the exemplary embodiment, the medium regulating component 1 is adopted to prevent the excessive floating of the medium described above.

Figure 1C:
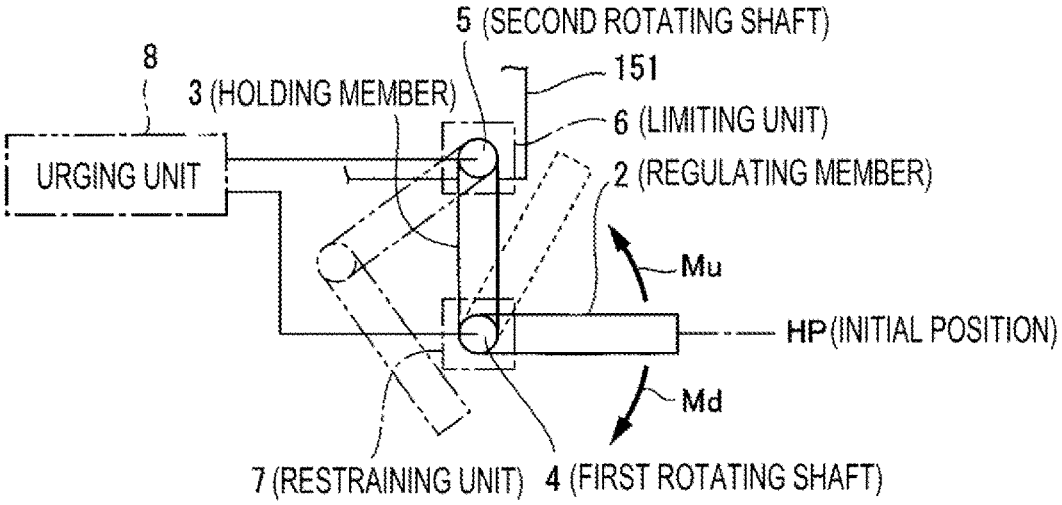
FIG. 1C is a schematic view of a medium regulating component.

In the example, as illustrated in FIGS. 1A to 1C, the medium regulating component 1 includes a regulating member 2 that protrudes in the horizontal direction from a periphery of the accommodating unit 151 and that comes into contact with the floating medium S1, a holding member 3 that holds the regulating member 2 in a non-contact state with the medium S1, a first rotating shaft 4 that supports the regulating member 2 to be rotatable with respect to the holding member 3, and a second rotating shaft 5 that supports the holding member 3 to be rotatable with respect to the accommodating unit 151. When the regulating member 2 receives a pressing force from below in a gravitational direction, as illustrated by Mu in FIG. 1C, the regulating member 2 rotates about the first rotating shaft 4 in a state where movement of the holding member 3 is suppressed. When the regulating member 2 receives a pressing force from above in the gravitational direction, as illustrated by Md in FIG. 1C, the regulating member 2 pushes the holding member 3 to rotate about the second rotating shaft 5.

In FIG. 1C, the regulating member 2 illustrated by the solid line is positioned in the initial position. Further, the regulating member 2 illustrated by the dotted line is a rotation trajectory when rotated in the Mu direction (corresponding to the upward rotating direction). Further, the regulating member 2 illustrated by the two-dot chain line is a rotation trajectory when rotated in the Md direction (corresponding to the downward rotating direction).

In such technical units, the regulating member 2 may simply protrude in a horizontal direction from the periphery of the accommodating unit 151. Examples of the regulating member 2 include one that protrudes not only from the side in the width direction intersecting the delivery direction of the media S accommodated in the accommodating unit 151 and one that protrudes in the horizontal direction from the rear of the side opposite to the delivery direction of the media S. Further, as for the cross-sectional shape of the regulating member 2, any shape such as a plate shape or a rod shape may be selected. The constituent piece of the regulating member 2 also broadly includes not only a single piece, but also plural pieces having an integrated structure, or separated pieces.

Further, the length dimension of the regulating member 2 may be freely selected. However, when the protruding dimension in the horizontal direction is too short, the contact area with the medium S1 may be too small when regulating the excessive floating, and, additionally, when the protruding dimension in the horizontal direction is too long, the floating operation of the medium may be impaired, and thus, the length dimension may be selected in an optimum range.

Further, the holding member 3 may be appropriately selected as long as it implements the function of holding the regulating member 2, and the cross-sectional shape, the length dimension, the number of constituent pieces, or the like may be appropriately selected.

Further, the first rotating shaft 4 and the second rotating shaft 5 each has a rotatable support shaft. It is noted that the present disclosure is not limited to this example. Alternatively, each of the first rotating shaft 4 and the second rotating shaft 5 may rotate about a virtual rotating shaft or may cover any other broad examples.

A representative example of the medium regulating component 1 implementing such functions includes a regulating member 2 that protrudes in the horizontal direction from a periphery of the accommodating unit 151 and that comes into contact with the floating medium S1, a holding member 3 that holds the regulating member 2 in a non-contact state with the medium S1, a first rotating shaft 4 that supports the regulating member 2 to be rotatable with respect to the holding member 3, and a second rotating shaft 5 that supports the holding member 3 to be rotatable with respect to the accommodating unit 151, a limiting unit 6 that limits movement of the holding member 3 when the regulating member 2 receives a pressing force from below in a gravitational direction to rotate upward, a restraining unit 7 that restrains the regulating member 2 with respect to the holding member 3 when the regulating member 2 receives a pressing force from above in the gravitational direction to rotate downward, and an urging unit 8 that urges the regulating member 2 to return to an initial position HP in which the regulating member 2 protrudes in the horizontal direction when the regulating member 2 rotates in an upward rotating direction (Mu direction) or in a downward rotating direction (Md direction) from the initial position HP.

In such technical units, the limiting unit 6 limits the movement of the holding member 3 to stop the holding member 3 at a predetermined position when the regulating member 2 rotates in the upward rotating direction (Mu direction), and thus, the rotational operation of the regulating member 2 about the first rotating shaft 4 is possible.

Further, the restraining unit 7 restraints the regulating member 2 with respect to the holding member 3 when the regulating member 2 rotates in the downward rotating direction (Md direction), and thus, the rotational operation of the regulating member 2 about the second rotating shaft 5 is possible while restraining the positional relationship between the regulating member 2 and the holding member 3.

Further, the urging unit 8 may urge the regulating member 2 to return to the initial position HP when the regulating member 2 rotates in the upward rotating direction (Mu direction) or the downward rotating direction (Md direction) from the initial position HP.

Here, in the case of the upward rotating direction (Mu direction), since the regulating member 2 may return to the initial position HP by its own weight rotation, the urging force in the direction opposite to the upward rotating direction is not always necessary. As a result, the urging unit 8 is required to have an urging force to return the regulating member 2 to the initial position HP when the regulating member 2 rotates at least in the downward rotating direction (Md direction).

Next, a representative example of the medium regulating component 1 will be described.

The second rotating shaft 5 may disposed above the first rotating shaft 4. In the example, the lowermost point position of the rotation trajectory of the regulating member 2 in the downward rotating direction (Md direction) may be disposed upward.

Particularly, the first rotating shaft 4 may be disposed substantially just below the second rotating shaft 5.

Further, as an example of the urging unit 8, a first urging unit that is provided about the first rotating shaft 4, and, when the regulating member 2 rotates in the upward rotating direction (Mu direction), urges the regulating member 2 in the direction of returning to the initial position HP is provided. In the example, when the first urging unit is not provided, the returning force by the own weight exists. However, in the example in which the first urging unit is provided, it is easy to return the regulating member 2 to the initial position as the urging force increases.

Further, the urging unit 8 may include a second urging unit that is provided around the second rotating shaft 5, and, when the regulating member 2 rotates in the downward rotating direction (Mu direction) in a state of being restrained by the holding member 3, urges the regulating member 2 in the direction of returning to the initial position HP.

Furthermore, the regulating member 2 and the first rotating shaft 4 may be arranged such that the rotation trajectory of the protruding end of the regulating member 2 when the regulating member 2 rotates about the second rotating shaft is positioned above the maximum load line of the media S accommodated in the accommodating unit 151.

Furthermore, the regulating member 2 and the second rotating shaft 5 may arranged such that the rotation trajectory of the protruding end of the regulating member 2 when the regulating member 2 rotates about the first rotating shaft 4 is positioned below the maximum load line of the media S accommodated in the accommodating unit 151.

Further, as an example of the retraction position when the regulating member 2 rotates in the downward rotating direction (Md direction), it is possible to retract to a retraction position beyond the vertical direction passing through the first rotating shaft 4. Therefore, when the media S are set in the accommodating unit 151, the media S may be set in a state where the regulating member 2 is completely retracted.

Further, examples of the limiting unit 6 include a rotation stop portion that stops the rotation of the holding member with respect to the accommodating unit 151 when the regulating member 2 rotates in the upward rotating direction (Mu direction).

Further, examples of the restraining unit 7 include a damming portion (stopper portion) that dams the holding member 3 with respect to the accommodating unit 151 when the regulating member 2 rotates in the downward rotating direction (Md direction).

Furthermore, in the medium feeding device including the levitating unit 154, the medium regulating component 1 may be provided in vicinity of the air blowing port 154*a* of the levitating unit 154 in the side portion of the accommodating unit 151.

Further, in an example in which a long size option is provided, in order to accommodate long size media having a longer dimension in the delivery direction of the media S than a normal length dimension, the accommodating unit 151 may include a standard accommodating portion capable of accommodating normal size media, and an extending accommodating portion that is adjacent to the standard accommodating portion and extends, and the medium regulating component 1 may be provided in both the standard accommodating portion and the extending accommodating portion.

Hereinafter, the present disclosure will be described in more detail based on the exemplary embodiments illustrated in accompanying drawings.

First Exemplary Embodiment

Figure 2:
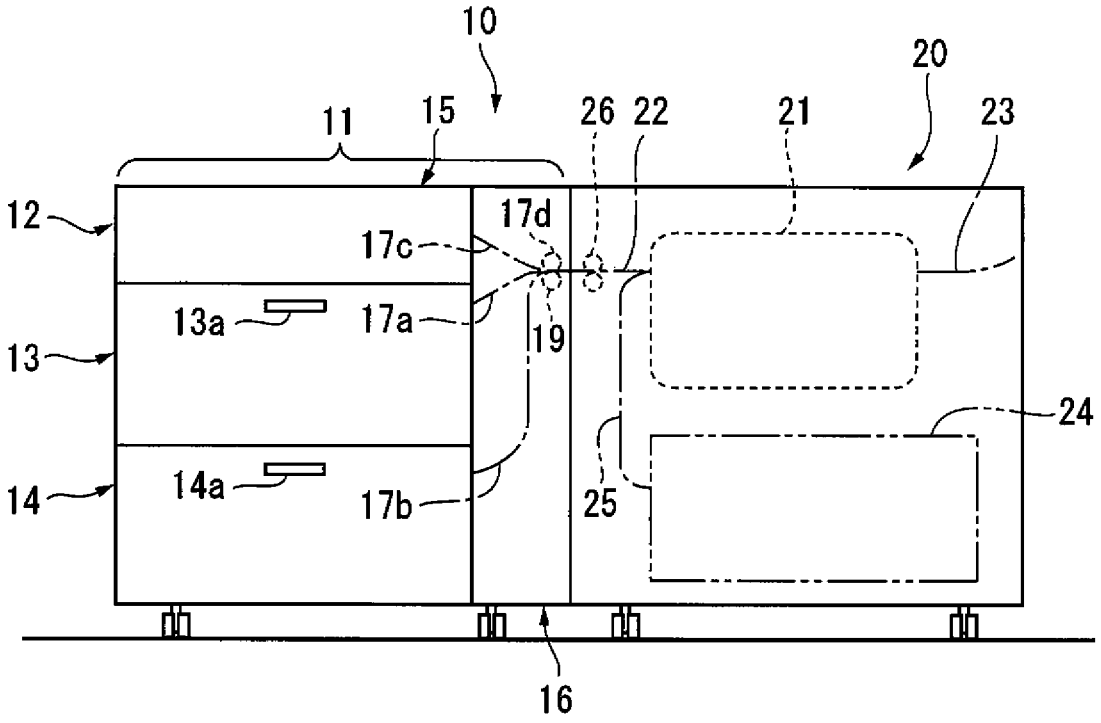
FIG. 2 is an explanatory view illustrating an overall configuration of a medium processing apparatus according to a first exemplary embodiment.

FIG. 2 illustrates an overall configuration of a medium processing apparatus according to a first exemplary embodiment.

Overall Configuration of Medium Processing Apparatus

In FIG. 2, a medium processing apparatus 10 includes a medium feeding device 11 that feeds sheet media one by one and a processing unit 20 serving as the processing unit that performs predetermined processing on the media fed from the medium feeding device 11.

In the example, the processing unit 20 includes an image forming unit 21 that forms an image on a medium, and the image forming unit 21, for example, adopting various image forming methods such as an electrophotographic method or an inkjet recording method is used. Then, in the processing unit 20, a sending transport path 22 that sends the medium fed from the medium feeding device 11 into the image forming unit 21, and a sending transport path 23 that sends out the medium on which an image is formed in the image forming unit 21 from the processing unit 20 are provided. Further, in the example, a built-in medium feeding unit 24 is separately provided below the image forming unit 21 in the processing unit 20, and the medium from the medium feeding unit 24 is fed to the image forming unit 21 via a feeding transport path 25. The reference numeral 26 indicates a sending roller 26 provided in the inlet of the sending transport path 22, and an appropriate number of transport members are provided in the sending transport path 22, the sending transport path 23, and the feeding transport path 25.

Overall Configuration of Medium Feeding Device

Figure 3:
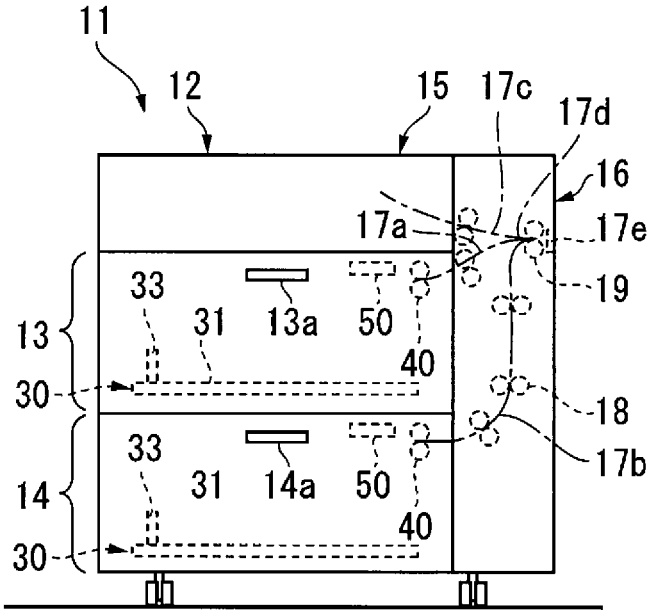
FIG. 3 is an explanatory view illustrating an example of the medium feeding device used in the medium processing apparatus according to the first exemplary embodiment.

In the example, as illustrated in FIGS. 2 and 3, the medium feeding device 11 includes a case 12 in which the media are accommodated. In the case 12, an upper drawer 13 and a lower drawer 14 that are of a two-stage configuration drawer type are disposed in the case 12 so as to be pulled out. A manual sheet feeding unit 15 capable of manually feeding the media is disposed in the upper portion of the case 12. Then, on the processing unit 20 side of the case 12, a relay unit 16 is disposed. The relay unit 16 relays and sends out the medium fed from the upper drawer 13, the lower drawer 14, and the manual sheet feeding unit 15 to the processing unit 20 side.

In the example, both the upper drawer 13 and the lower drawer 14 have a configuration in which a large number of media are accommodated and are fed one by one. Further, the relay unit 16 includes a first sending path 17*a* that sends out the medium fed from the upper drawer 13, a second sending path 17*b* that sends out the medium fed from the lower drawer 14, and a third sending path 17*c* that sends out the medium fed from the manual sheet feeding unit 15. The first to third sending paths 17*a* to 17*c* are provided with an appropriate number of transport rollers 18, and a merging transport path 17*d* connected to a discharge port 17*e* to the processing unit 20 is formed on the outlet side of the first to third sending paths 17*a* to 17*c*, and a discharge roller 19 is provided in the emerging transport path 17*d*. The upper drawer 13 and the lower drawer 14 are provided with handles 13*a* and 14*a*, respectively, and may be pulled out to the front side.

Example of Configuration of Upper Drawer (Lower Drawer)

In the example, the upper drawer 13 and the lower drawer 14 are configured substantially in the same manner, and the upper drawer 13 will be described below as an example.

Figure 4:
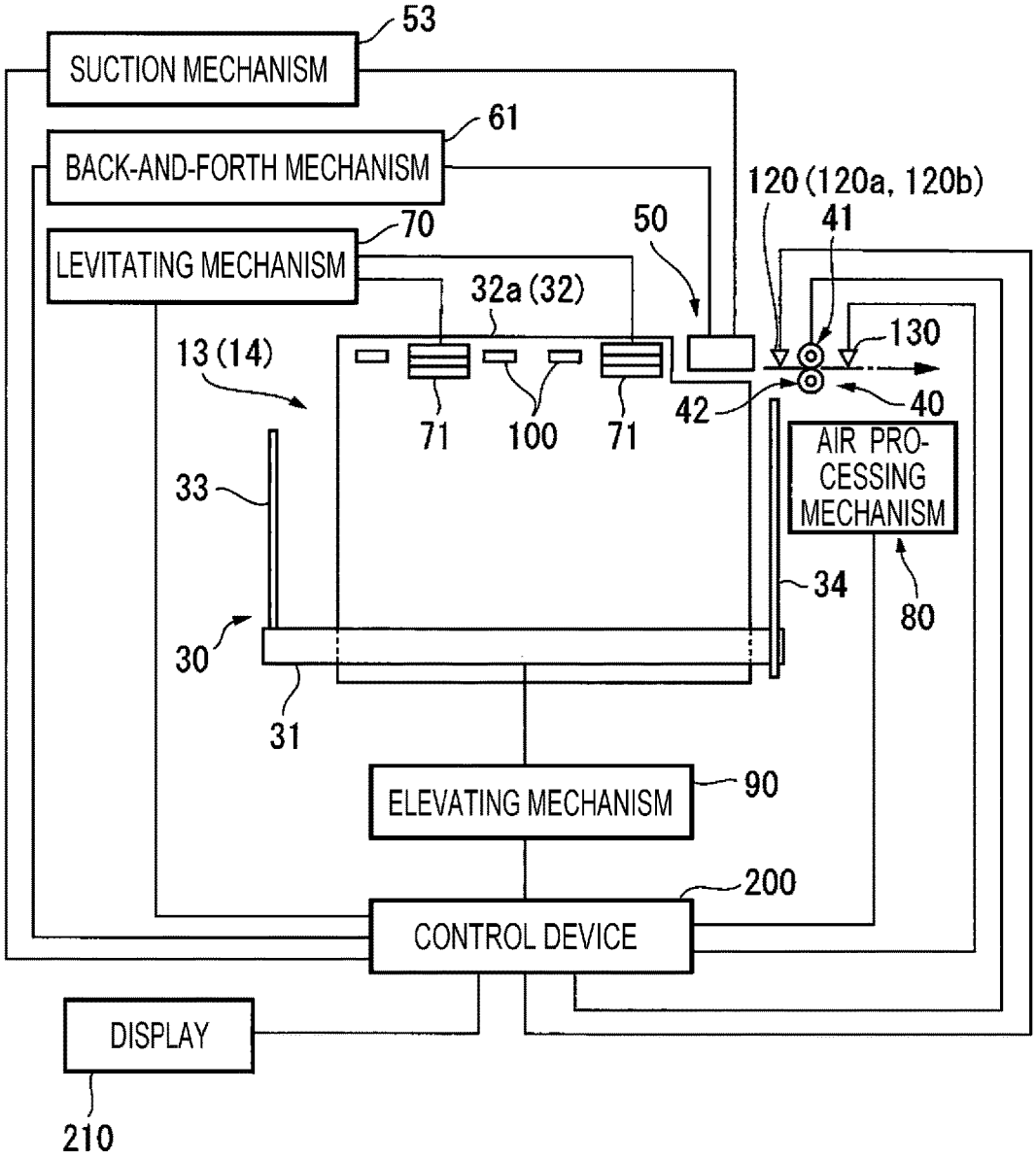
FIG. 4 is an explanatory view illustrating a control system of the medium feeding device according to the first exemplary embodiment.

In the example, for example, as illustrated in FIG. 4, the upper drawer 13 includes an accommodating portion 30 serving as the accommodating unit that accommodates sheet media, a delivery roller 40 serving as the delivery unit that is provided on a delivery direction side of the media accommodated in the accommodating portion 30 and delivers the media one by one, a vacuum head 50 serving as the transfer unit that is provided above the accommodating portion 30 and adsorbs a medium accommodated in the accommodating portion 30 to transfer to the delivery roller 40, a levitating mechanism 70 serving as the levitating unit that is provided on a side intersecting the delivery direction of the media accommodated in the accommodating portion 30 and blows air to the side of the media to levitate the medium in a state where the upper area of the medium is separated, and an air processing mechanism 80 that is provided on the delivery direction side of the media accommodated in the accommodating portion 30, and blows air between the upper medium levitated by the levitating mechanism 70 and the media positioned below the levitated medium to process the levitated medium.

Accommodating Portion

Figure 5:
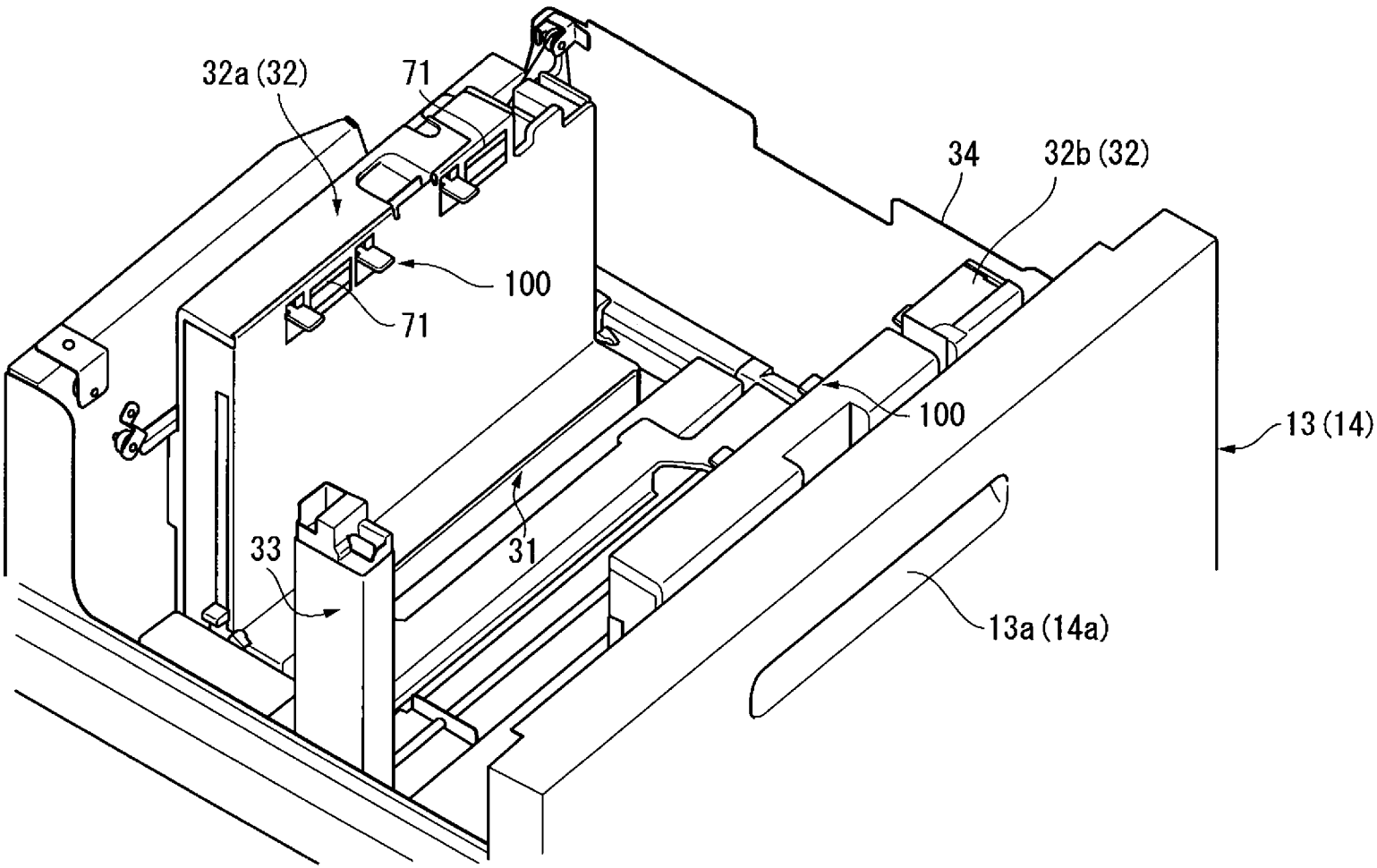
FIG. 5 is an explanatory perspective view illustrating an example of a configuration of a medium accommodating portion of the medium feeding device according to the first exemplary embodiment.

In the example, as illustrated in FIGS. 4 and 5, the accommodating portion 30 includes a loading bottom plate 31 on which media of various sizes are loaded, side guides 32 (specifically, 32*a* and 32*b*) serving as a side guide unit that are provided on the side in the width direction intersecting the delivery direction of the media of various sizes loaded on the loading bottom plate 31, and position and guide the side position of the media, an end guide 33 serving as a rear guide unit that is provided on the rear side opposite to the delivery direction of the media loaded on the loading bottom plate 31, and positions and guides the rear position of the media, and a partition plate 34 that partitions the position on the delivery direction side of the media loaded on the loading bottom plate 31.

In the example, the accommodating portion 30 may be designed according to the size of the medium to be used. Alternatively, from the viewpoint of versatility, a normal size medium may be mainly used. As the normal size medium referred to here, for example, a medium having a length of up to 488 mm in the longitudinal direction is used, and an example of the medium having such size includes a medium having JIS standard A3 size or smaller.

In the example, the side guides 32 are movable along the width direction of the loading bottom plate 31, and are positioned at a predetermined positioning position. Further, the end guide 33 is movably provided along the delivery direction of the media on the loading bottom plate 31, and is positioned at a predetermined positioning position. Further, in the example, the partition plate 34 is provided with plural (two in the example) stopper pieces 35 (see FIG. 8) that protrude upward from the upper edge of the corresponding partition plate 34, and the stopper piece 35 functions as a stopper wall 36 that dams the upper area of the medium group when the levitating mechanism 70 is not used.

Further, as illustrated in FIG. 4, the loading bottom plate 31 is supported to be movable up and down by an elevating mechanism 90 which will be described later (see FIGS. 10A and 10B).

Delivery Roller

Figure 8:
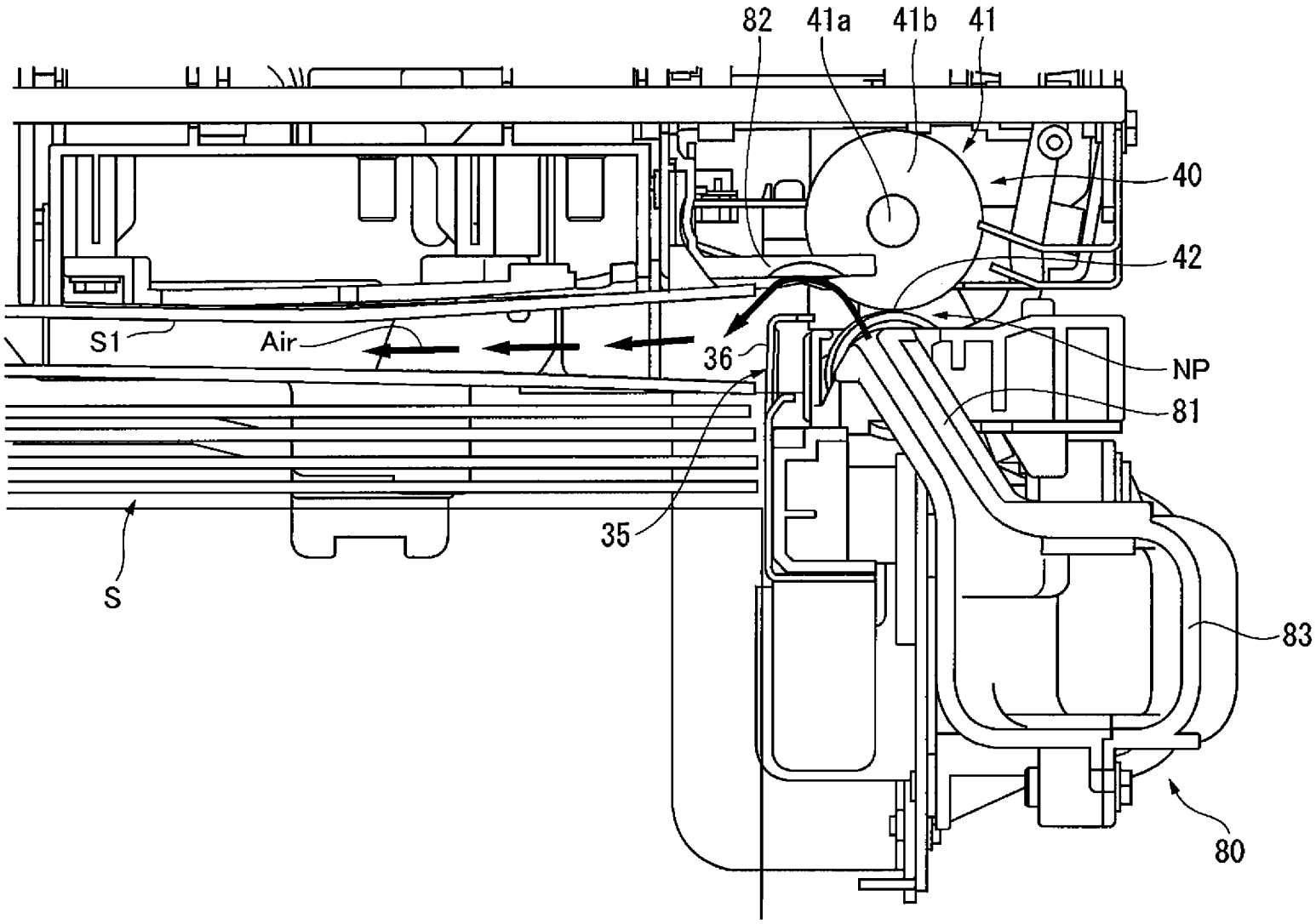
FIG. 8 is an explanatory view illustrating an example of a configuration of an air processing mechanism illustrated in FIG. 4.
Figure 11:
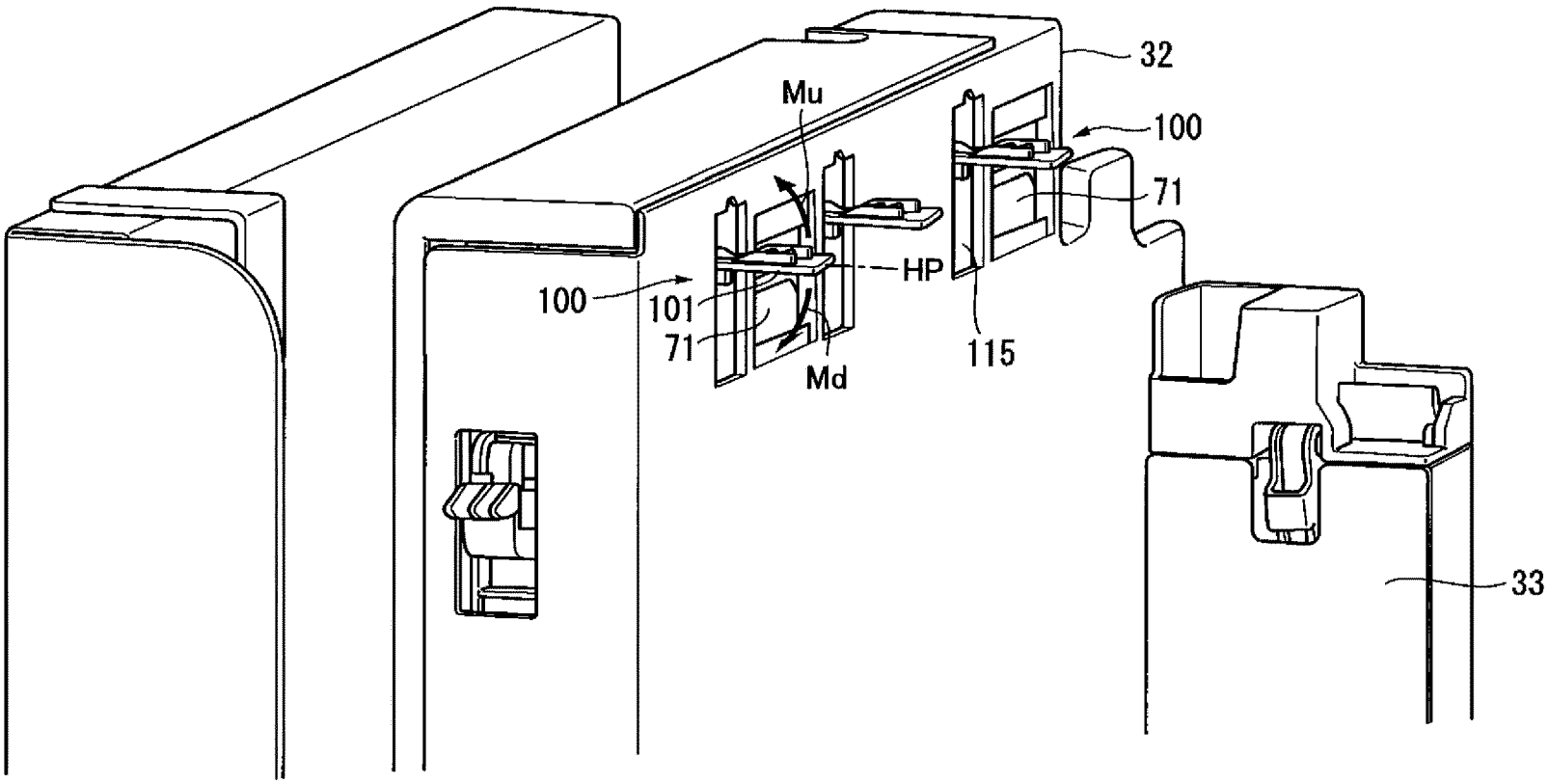
FIG. 11 is an explanatory view illustrating a basic behavior of a medium regulating component used in the first exemplary embodiment.

In the example, as illustrated in FIGS. 4, 8, and 11, the delivery roller 40 includes a driving roller 41 including plural divided roller bodies 41*b* and 41*c* on a driving shaft 41*a* that is driven to rotate, and a follower roller 42 that is followed to rotate following the rotation of the driving roller 41, and includes plural divided roller bodies 42*b* and 42*c* on a driving shaft 42*a*. The medium is nipped in the contact portion NP (specifically, corresponding to the nip area between the divided roller bodies 41*b* and 42*b*, 41*c* and 42*c*) between the driving roller 41 and the follower roller 42 to be transported.

The case where the divided roller bodies 41*b* and 42*b* are collectively referred to is referred to as a "divided roller 43", and the case where the divided roller bodies 41*c* and 42*c* are collectively referred to is referred to as a "divided roller 44".

Vacuum Head

Figure 6:
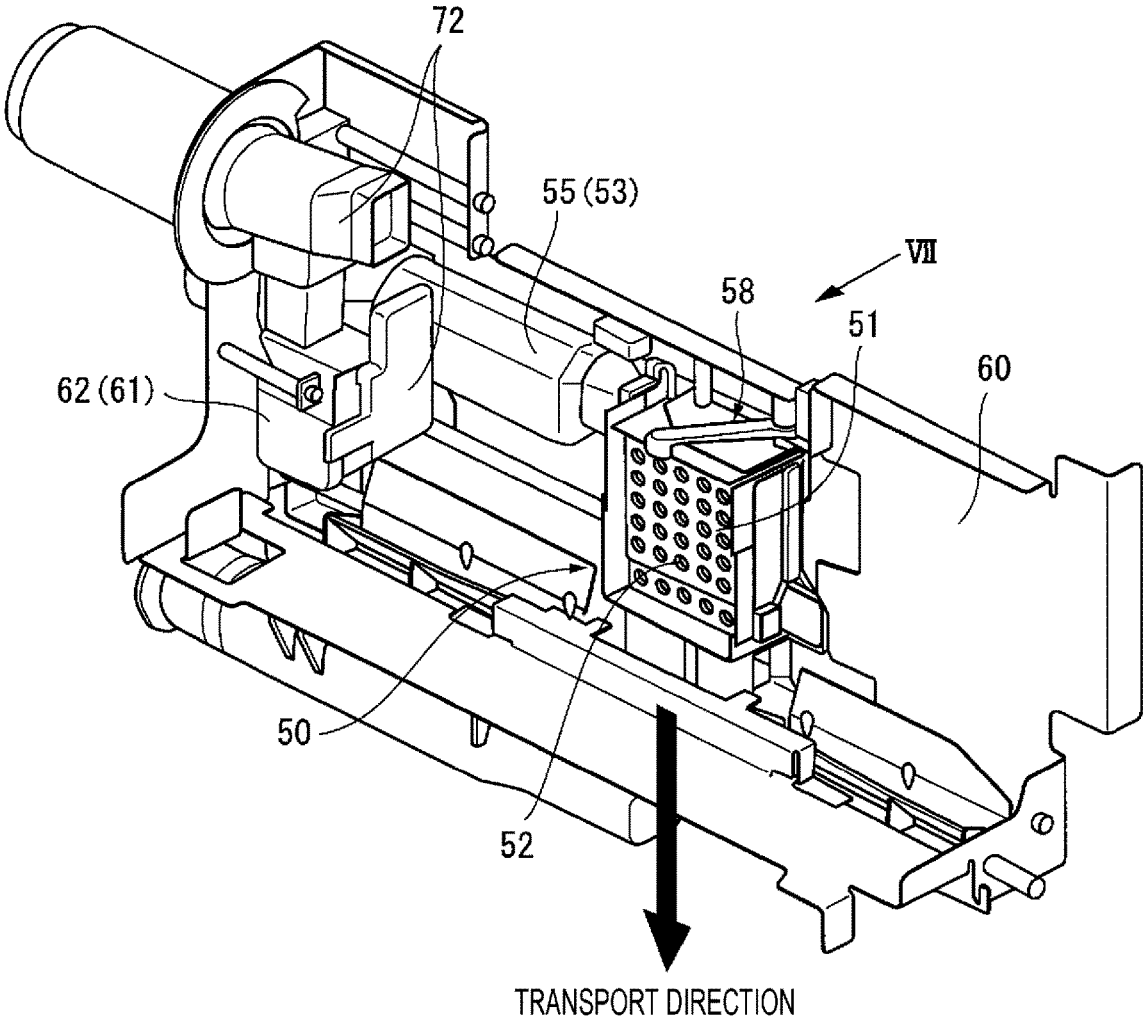
FIG. 6 is an explanatory view illustrating details of a vacuum head as a transfer unit according to the first exemplary embodiment.
Figure 7:
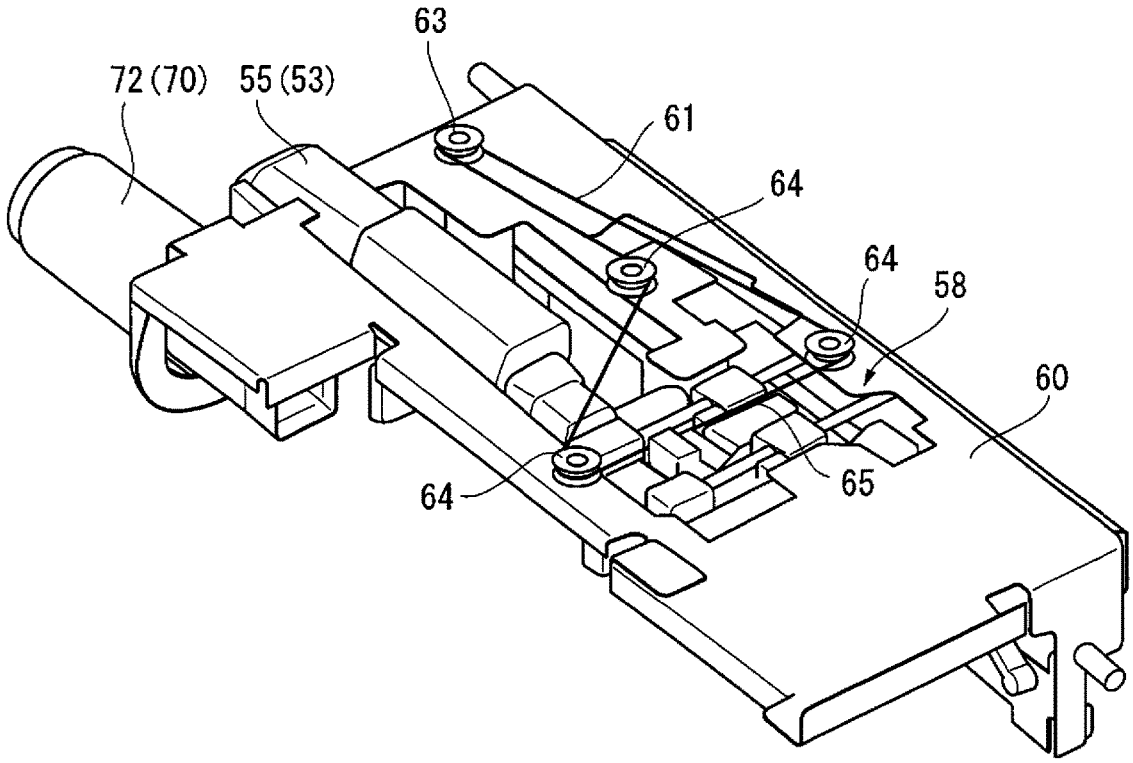
FIG. 7 is an explanatory cross-sectional view as viewed from a VII direction in FIG. 6.
Figure 9A:
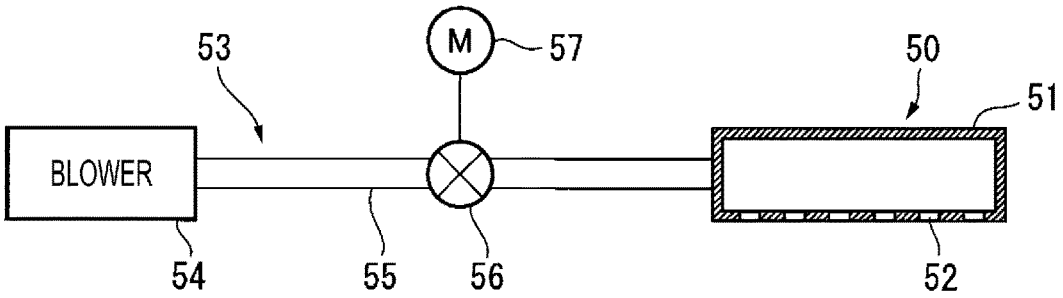
FIG. 9A is an explanatory view illustrating an example of a configuration of a levitating mechanism illustrated in FIG. 4.

In the example, as illustrated in FIGS. 6, 7, and 9A, the vacuum head 50 is supported via a guide mechanism 58 (for example, guide rod is used) with respect to a head frame 60 that is fixed to the case 12 above the accommodating portion 30, and is movable back and forth along the delivery direction of the media.

In the example, the vacuum head 50 includes a head body 51 having a hollow box shape, and plural vacuum holes 52 are opened on the surface of the head body 51 facing the media accommodated in the accommodating portion 30, and a suction mechanism 53 is connected to the head body 51. Here, the suction mechanism 53 in which a vacuum duct 55 connects a suction blower 54 and the head body 51, a vacuum valve 56 that opens and closes the flow path is interposed in the middle of the vacuum duct 55, and the vacuum valve 56 is opened/closed by a valve motor 57 is adopted.

Then, the head frame 60 is provided with a back-and-forth mechanism 61 that moves the vacuum head 50 back and forth. In the example, as illustrated in FIGS. 6 and 7, in the back-and-forth mechanism 61, a stepping motor 62 is fixed to the head frame 60, a driving pulley 63 is connected to the stepping motor 62, and, again, the head frame 60 is provided with an appropriate number of transmission pulleys 64 at appropriate locations, and a wire 65 is hung on the driving pulley 63 and the transmission pulleys 64, and a part of the wire 65 is fixed to the vacuum head 50. In the example, the driving pulley 63 rotates in association with the forward and reverse rotation of the stepping motor 62, and, consequently, the wire 65 moves by a predetermined amount, and the vacuum head 50 is moved back and forth in the delivery direction of the media.

Levitating Mechanism

Figure 9B:
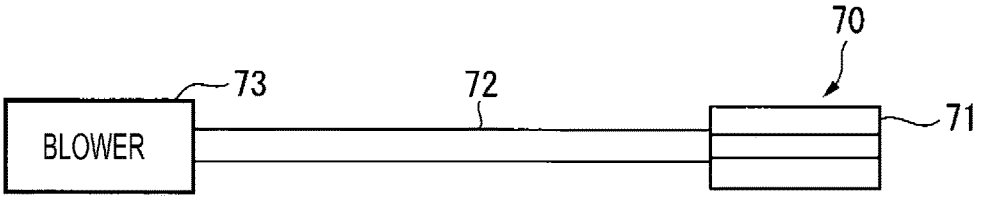
FIG. 9B is an explanatory view illustrating an example of a configuration of a suction mechanism to the vacuum head illustrated in FIG. 4.

In the example, as illustrated in FIGS. 4, 5, and 9B, in the levitating mechanism 70, for example, for example, the side guides 32 (32*a* and 32*b*) are formed in a hollow box shape, plural air blowing ports 71 are opened above the location of the side guides 32 facing the side of the media, an air duct 72 that communicates with an air blowing port 71 at one end is disposed in the hollow portion of the side guide 32, and the other end of the air duct 72 is communicated with a blowing blower 73. The blower 73 may be provided inside the side guide 32, or may be provided by externally attaching to the side guide 32.

Further, in the example, a medium regulating component 100 is provided near to the air blowing port 71 of the side guide 32. A medium regulating component 100 in the example is provided in the side of the media loaded on the loading bottom plate 31, and protrudes into the medium accommodating area to function to regulate the excessive floating of the medium that is levitated when the levitating mechanism 70 is used.

Air Processing Mechanism

Figure 9C:
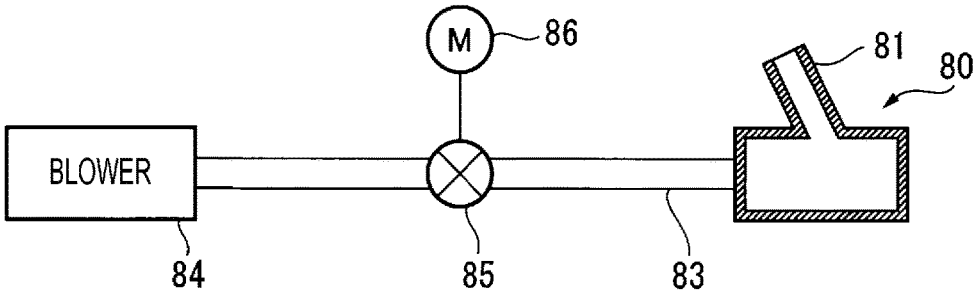
FIG. 9C is an explanatory view illustrating an example of an air supply system to the air processing mechanism illustrated in FIG. 4.

In the example, as illustrated in FIGS. 4, 8, and 9C, the air processing mechanism 80 includes an air nozzle 81 that blows air in a knife shape from the lower side to the rear obliquely toward the end portion of the delivery direction side of the medium levitated by the levitating mechanism 70, and the air blown from the air nozzle 81 is changed in direction by an air guide plate 82, and air is blown between the upper medium levitated by the levitating mechanism 70 and the media positioned below the levitated medium to process the levitated medium.

Then, in the example, the air nozzle 81 is communicated with an air duct 83, and an air blowing blower 84 is connected to the air duct 83. Then, an opening/closing valve 85 that opens and closes the flow path is provided in the middle of the air duct 83, and the opening/closing valve 85 is opened/closed by a valve motor 86.

Elevating Mechanism

Figure 10A:
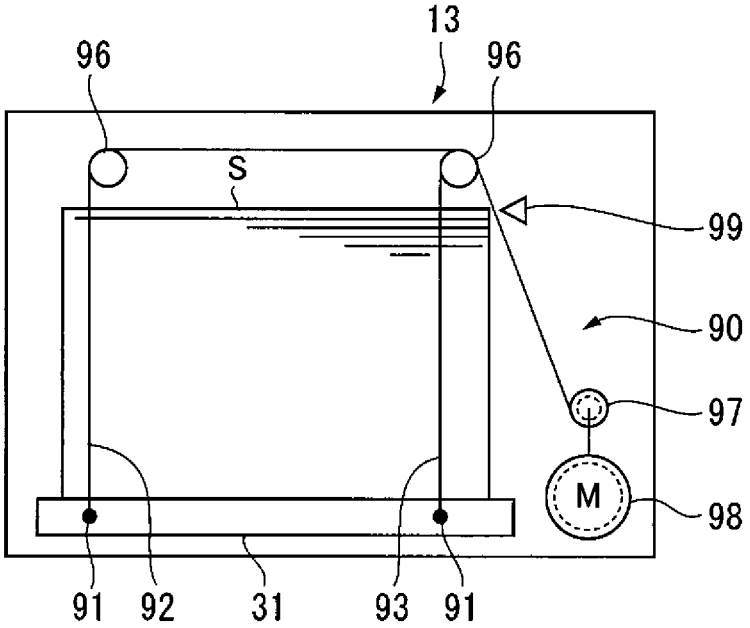
FIG. 10A is an explanatory view illustrating an example of a configuration of an elevating mechanism illustrated in FIG. 4.
Figure 10B:
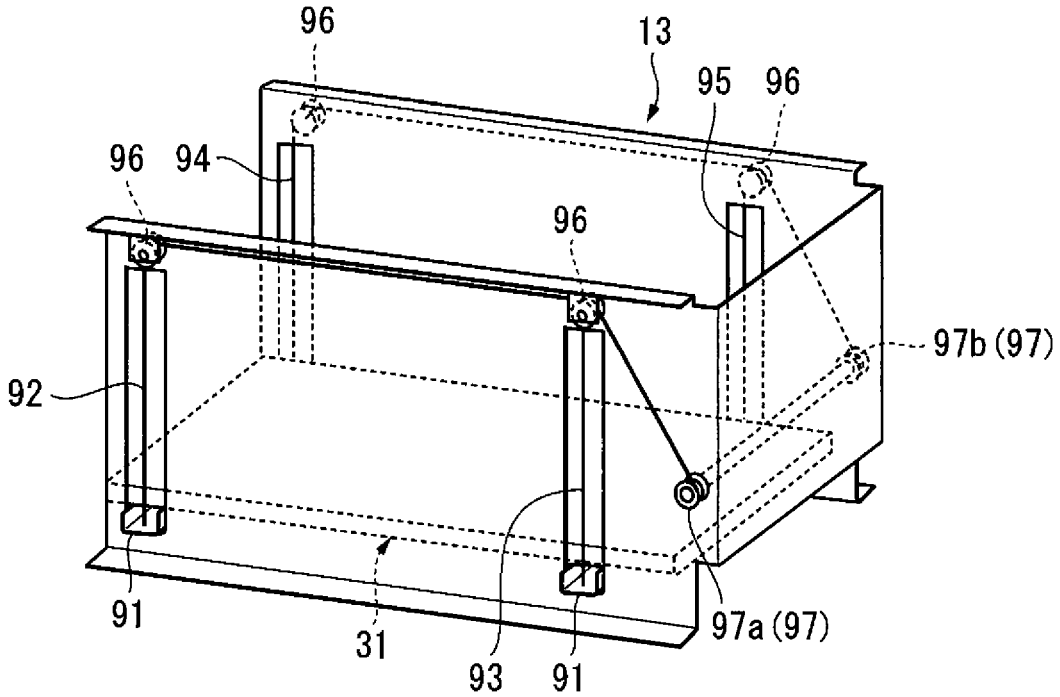
FIG. 10B is an explanatory perspective view illustrating a main part of the elevating mechanism illustrated in FIG. 10A.

As illustrated in FIGS. 4, 10A, and 10B, the elevating mechanism 90 is provided with hanging portions 91 in the loading bottom plate 31 at four locations on both sides of the width direction intersecting the delivery direction of the media. The respective hanging portions 91 are provided with four wires 92 to 95 having terminals respectively divided and connected. The respective wires 92 to 95 are hung on one or plural guide pulleys 96. After that, one end sides of the respective wires 92 to 95 are fixed to winding pulleys 97 (97*a* and 97*b* in the example) connected by a same shaft. The winding pulleys 97 are rotated by a driving motor 98 capable of rotating forward and reversely to move the respective wires 92 to 95 by a predetermined amount, so that the loading bottom plate 31 moves up and down while maintaining a parallel posture. The reference numeral 99 indicates a height sensor that sets the surface of the medium loaded in the loading bottom plate 31 to a predetermined height position.

Position Sensor

Further, in the exemplary embodiment, as illustrated in FIG. 4, with the delivery roller 40 being interposed, a front stage position sensor 120 is provided on the upstream side in the delivery direction of the media, and a rear stage position sensor 130 is provided on the downstream side in the delivery direction of the media.

Plural (two in the example, specifically 120*a* and 120*b*) front stage position sensors 120 are provided in the area before reaching the nip area NP of the delivery roller 40, which is the delivery roller 40 side of the position of the end portion of the delivery direction side of the media accommodated in the accommodating portion 30.

Then, the front stage position sensors 120 are provided at intervals in the width direction intersecting the delivery direction of the media, in other words, in the axial direction of the delivery roller 40, and detect the position of the end portion of the delivery direction side of the medium. As a result, the front stage position sensor 120 is used as information for determining whether the medium is passed, and additionally, for determining the degree of skewed state of the medium.

Meanwhile, one rear stage position sensor 130 detects that the medium passes through the nip area NP of the delivery roller 40, and is provided in the passing area of the medium.

In the front stage position sensor 120, a light emitting element that emits light toward the delivered medium and a light receiving element that receives the reflected light from the medium are arranged side by side in the sensor case. It is possible to detect that the end portion of the delivery direction side of the medium passes through the front stage position sensor at the light receiving timing to the light receiving element. The rear stage position sensor 130 also includes substantially the same configuration as that of the front stage position sensor 120.

Control System

In the example, as illustrated in FIG. 4, a control device 200 that controls the medium feeding device 11 is provided. The control device 200 is implemented by, for example, a microcomputer including a CPU, a ROM, a RAM, an I/O port, and the like, and various information in association with job designation or the like, or signals from various sensors (for example, front stage position sensor 120 and rear stage position sensor 130) are stored in the CPU, and calculated in accordance with a program installed in advance in the ROM, and a predetermined control signal is sent out to each control target.

In the example, the control target may include, for example, the delivery roller 40, the vacuum head 50 (suction mechanism 53 and back-and-forth mechanism 61), the levitating mechanism 70, the air processing mechanism 80, and the elevating mechanism 90, and, additionally, the control device 200 is provided with a display 210 that displays the progress status of the medium feed job, an abnormality warning of the medium feed status, or the like.

Medium Regulating Component

Basic Behavior of Medium Regulating Component

In the exemplary embodiment, as illustrated in FIGS. 4, 5, and 11, the medium regulating components 100 are provided at intervals at three locations on the inner side surface of the side guides 32 (32*a* and 32*b*) that position and guide the media S.

Particularly, in the example, the levitating mechanism 70 is provided, and the medium regulating component 100 is disposed in the vicinity of the air blowing port 71 of the levitating mechanism 70 in the delivery direction of the media.

In the example, the medium regulating component 100 includes a plate-shaped regulating arm 101 serving as a regulating member extending in the horizontal direction from the inner side surface of the side guides 32 (32*a* and 32*b*).

The regulating arm 101 implements three functions.

The first function is that the regulating arm 101 maintains a horizontal posture as the initial position HP, and is brought into contact with the side of the floating medium in the accommodating portion 30 to suppress excessive floating of the medium.

The second function is that, when the regulating arm 101 receives a pressing force upward from below in a gravitational direction, the regulating arm 101 rotates in the direction of arrow Mu in FIG. 11, and the protruding dimension with respect to the horizontal direction is reduced as compared with the case of being positioned in the initial position HP. As a result, for example, when the medium S accommodated in the accommodating portion 30 is temporarily removed, it is possible to temporarily retract the regulating arm 101 upward from the initial position HP.

The third function is that, when the regulating arm 101 receives a pressing force downward from above in the gravitational direction, the regulating arm 101 rotates in the direction of arrow Md in FIG. 11, and is disposed at the retraction position where the protruding dimension with respect to the horizontal direction is reduced as compared with the case of being positioned in the initial position HP. As a result, for example, when the medium is replenished and set in the accommodating portion 30, it is possible to temporarily retract the regulating arm 101 downward from the initial position HP.

Example of Configuration of Medium Regulating Component

Figure 12:
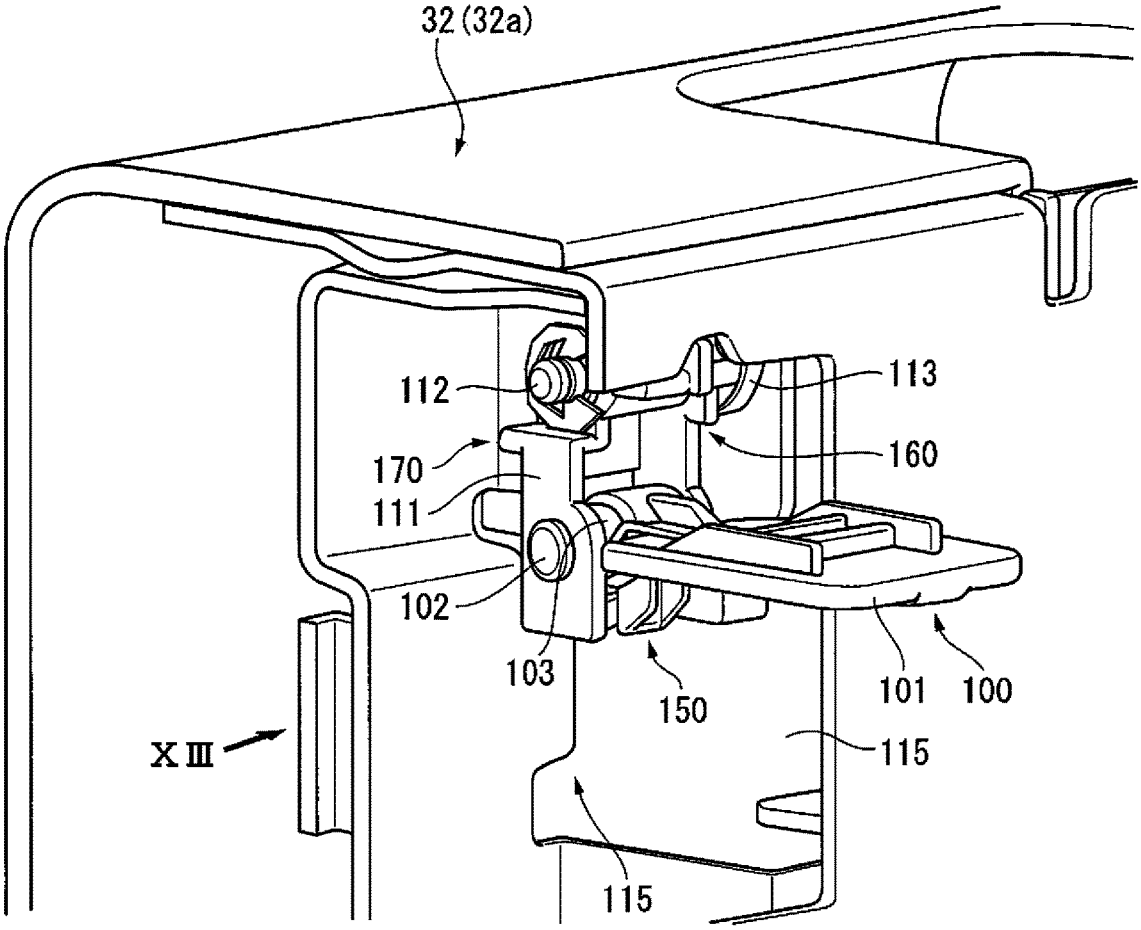
FIG. 12 is an explanatory perspective view illustrating details of the medium regulating component used in the first exemplary embodiment.
Figure 13:
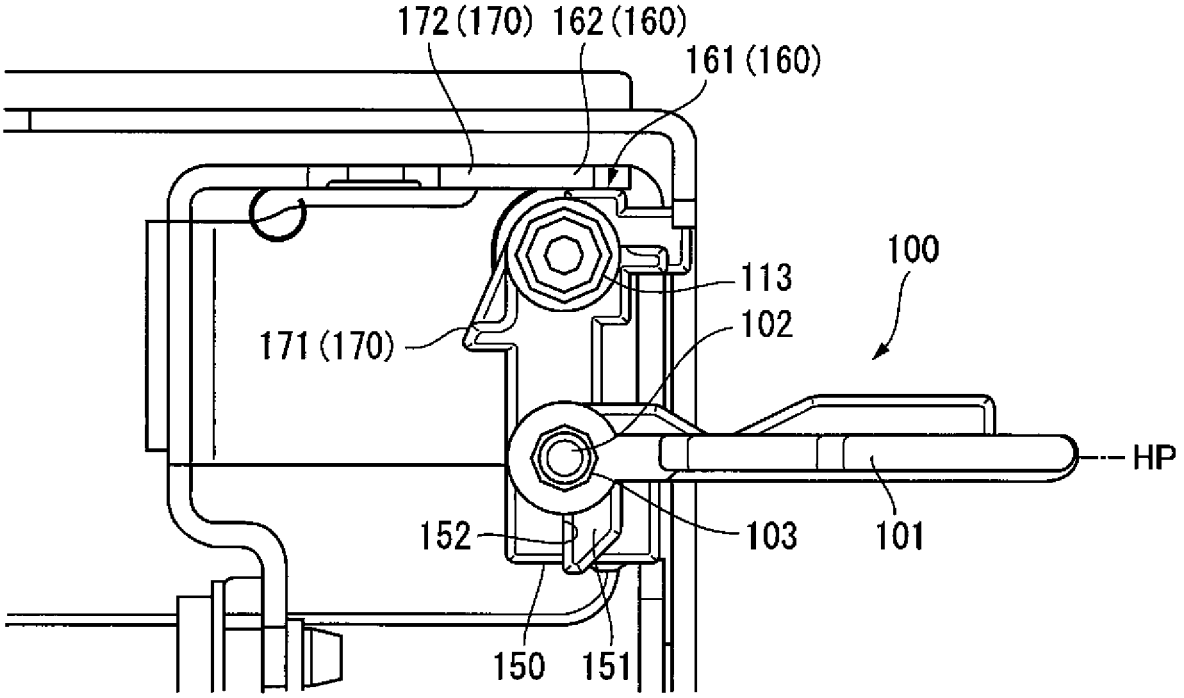
FIG. 13 is an explanatory cross-sectional view as viewed from a XIII direction in FIG. 12.
Figure 14:
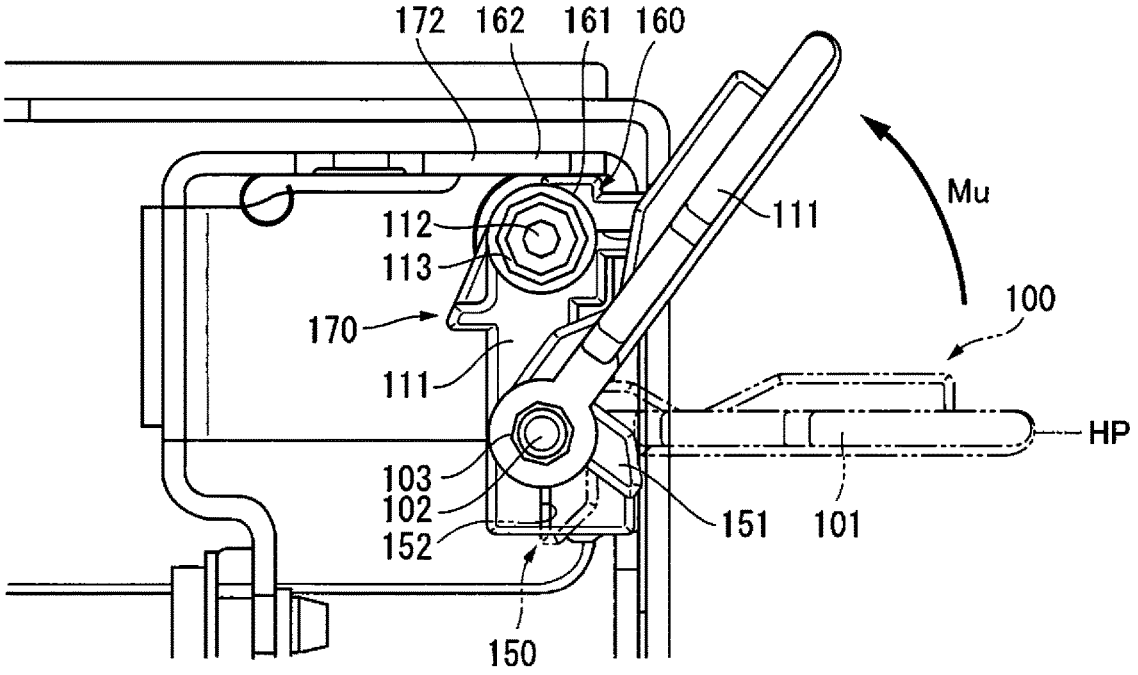
FIG. 14 is an explanatory view illustrating a behavior of a regulating arm when receiving a pressing force from below in a gravitational direction.

In the example, as illustrated in FIGS. 12 and 13, the medium regulating component includes the regulating arm 101 described above, a holding arm 111 that is used to hold the regulating arm 101, and is disposed to be substantially orthogonal to the regulating arm 101 and to extend in the vertical direction, a first rotating shaft 102 that rotatably supports the regulating arm 101 on the lower end side of the holding arm 111, and a second rotating shaft 112 that rotatably supports the upper end side of the holding arm 111 with respect to the side guide 32.

In the example, the first rotating shaft 102 is disposed substantially just below the second rotating shaft 112.

Further, in the example, a first urging spring 103 serving as an urging unit is mounted around the first rotating shaft 102, and the first urging spring 103 applies an urging force between the regulating arm 101 and the holding arm 111 so that the regulating arm 101 and the holding arm 111 maintain an angular relationship of approximately 90°. When the regulating arm 101 rotates in a direction approaching the holding arm 111 about the first rotating shaft 102, the first urging spring 103 urges the regulating arm 101 to return to the initial position HP with respect to the holding arm 111.

Further, a second urging spring 113 serving as an urging unit is mounted around the second rotating shaft 112, and the second urging spring 113 applies an urging force between the side guide 32 and the holding arm 111 so that the holding arm 111 maintains the substantially vertical position with respect to the side guide 32. When the holding arm 101 rotates in the counter-clockwise direction from the vertical posture, the second urging spring 113 urges the holding arm 111 to return to the vertical position.

Restraining Mechanism

Further, in the example, a restraining mechanism 150 serving as the restraining unit is provided around the first rotating shaft 102 of the regulating arm 101 and the holding arm 111. In the example, the restraining mechanism 150 includes a damming projection 151 that is formed in the vicinity of the first rotating shaft 102 of the regulating arm 101 to protrude in the radial direction of the first rotating shaft 102, and a damming receiving portion 152 that is provided in the vicinity of the first rotating shaft 102 of the holding arm 111 and abuts onto the damming projection 151 when the regulating arm 101 is positioned at the initial position HP.

That is, in the restraining mechanism 150, when the regulating arm 101 is positioned in the initial position HP, the damming projection 151 on the regulating arm 101 side abuts onto the damming receiving portion 152 on the holding arm 111 side, and thus, the regulating arm 101 tries to rotate in the downward rotating direction (Md direction), the holding arm 111 and the regulating arm 101 rotate integrally about the second rotating shaft 112 while maintaining the restrained state by the restraining mechanism 150.

Rotation Stop Mechanism

Further, in the example, a rotation stop mechanism 160 serving as the limiting unit that limits the rotational movement of the holding arm 111 rotating from the vertical posture in the counter-clockwise direction is provided about the second rotating shaft 112.

In the rotation stop mechanism 160 in the example, a rotation stop projection 161 is formed around the second rotating shaft 112 of the holding arm 111 to be projected in the radial direction of the second rotating shaft 112, and a plate-shaped rotation stop receiver 162 onto which the rotation stop projection 161 abuts is provided on the side guide 32 side.

According to the example, even though an external force from the vertical posture toward the counter-clockwise direction acts on the holding arm 111, the rotational operation of the holding arm 111 in the counter-clockwise direction is limited by the rotation stop mechanism 160.

Stopper Mechanism

Further, in the exemplary embodiment, when the holding arm 111 rotates in the clockwise direction about the second rotating shaft 112, a stopper mechanism 170 that stops the rotational operation at a predetermined position is provided.

In the stopper mechanism 170, a stopper projection 171 that protrudes in the direction intersecting a line connecting the stop of the first rotating shaft 102 and the second rotating shaft 112 is provided at a location on the side of the holding arm 111 opposite to the regulating arm 101, and a plate-shaped stopper receiver 172 onto which the stopper projection 171 abuts is provided on the side guide 32 side. In the example, the stopper receiver 172 is implemented by the same member as the rotation stop receiver 162, but, of course, may be implemented by a separate member.

According to the example, the holding arm 111 rotates in the clockwise rotating direction from the vertical posture, but the rotation of the holding arm 111 in the clockwise rotating direction is stopped by the stopper mechanism 170 in a stage of reaching a predetermined position.

Operation of Medium Regulating Component (1) Initial Position of Regulating Arm

As illustrated in FIG. 1A to 1C, the regulating arm 101 is disposed in the predetermined initial position HP when a pressing force from above or below in the gravitational direction is not applied.

The initial position HP of the regulating arm 101 protrudes in the horizontal direction, and is set to a predetermined position by maintaining the holding arm 111 in the vertical posture by the second urging spring 113 and the rotation stop mechanism 160, and, additionally, maintaining the regulating arm 101 in the angular relationship of approximately 90° with respect to the holding arm 111 by the first urging spring 103 and the restraining mechanism 150, and in the protruding state.

In the example, even when the medium in the accommodating portion 30 is levitated by the levitating mechanism 70, the side of the medium is brought in contact with the regulating arm 101 positioned at the initial position HP, and thus the side portion of the medium does not float excessively.

(2) Upward Rotational Movement of Regulating Arm

When the regulating arm 101 receives a pressing force upward from below in the gravitational direction, a rotational moment acts on the regulating arm 101 in the counter-clockwise direction about the first rotating shaft 102, and, due to the rotational moment, a rotational moment acts on the holding arm 111 in the counter-clockwise direction about the second rotating shaft 112. However, since the holding arm 111 is not able to rotate in the counter-clockwise direction by the rotation stop mechanism 160, the regulating arm 101 rotates in the Mu direction about the first rotating shaft 102.

When the regulating arm 101 does not receive the pressing force from below in the gravitational direction, the regulating arm 101 returns to the initial position HP by the urging force of the first urging spring 103.

(3) Downward Rotational Movement of Regulating Arm

Figure 15:
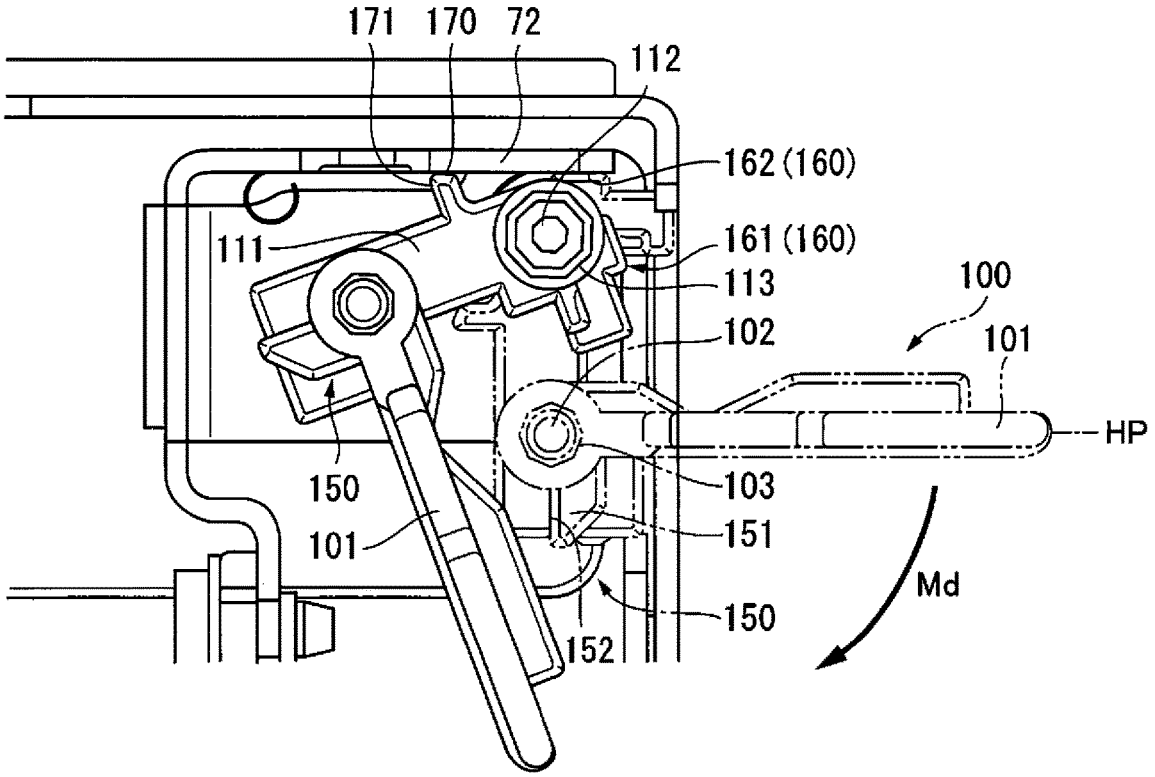
FIG. 15 is an explanatory view illustrating a behavior of the regulating arm when receiving a pressing force from above in the gravitational direction.
Figure 16:
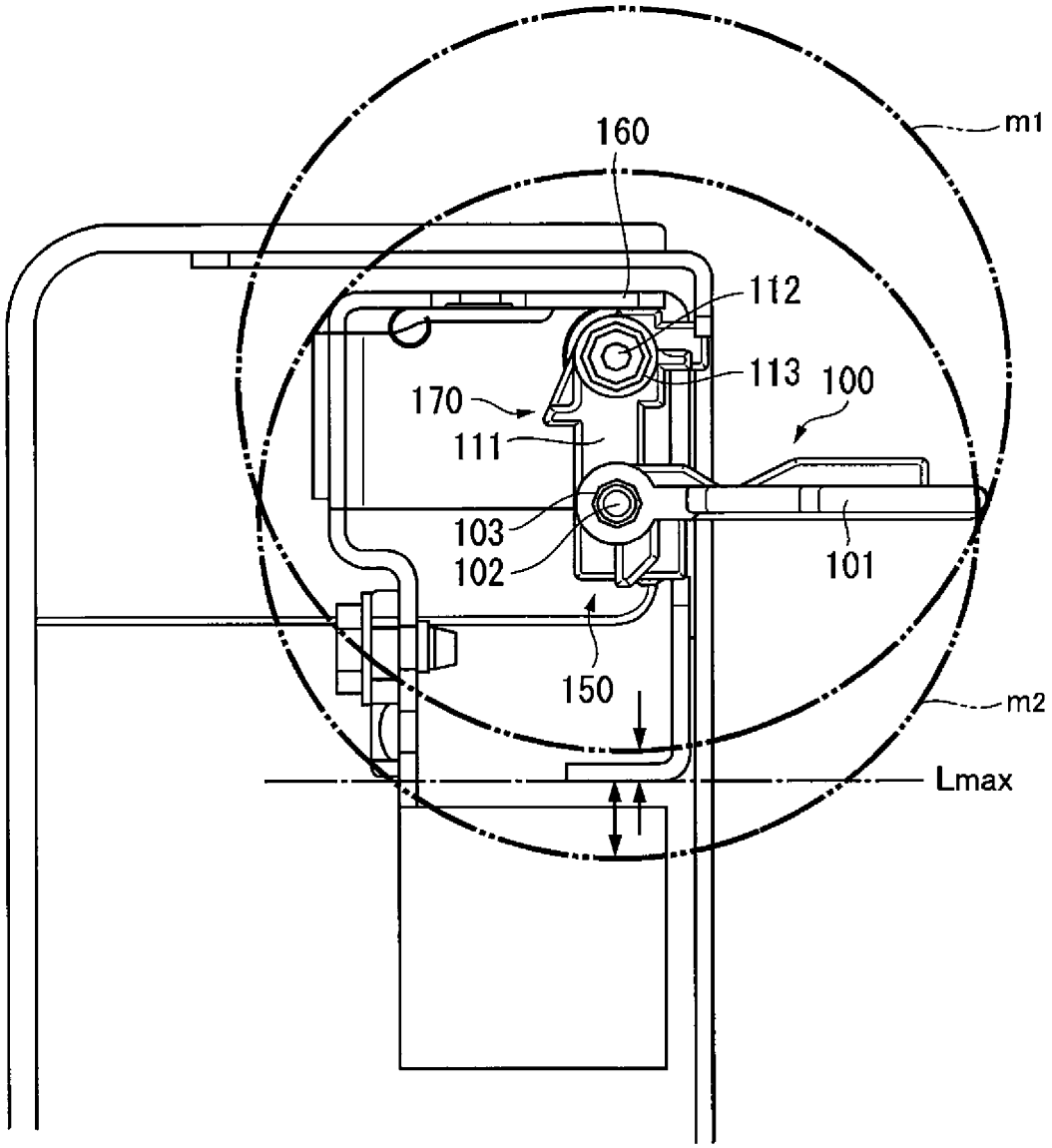
FIG. 16 is an explanatory view illustrating a layout of the regulating arm.

When the regulating arm 101 receives a pressing force downward from above in the gravitational direction, as illustrated in FIG. 15, a rotational moment acts on the regulating arm 101 in the clockwise rotating direction about the first rotating shaft 102, and, due to the rotational moment, a rotational moment acts on the holding arm 111 in the clockwise rotating direction about the second rotating shaft 112.

In this case, since the regulating arm 101 and the holding arm 111 are restrained with each other by the restraining mechanism 150, the regulating arm 101 rotates in the clockwise rotating direction about the second rotating shaft 112 in a state of being restrained by the holding arm 111. As a result, the regulating arm 101 rotates downward in the direction of the arrow Md.

Then, since the holding arm 111 rotates together with the regulating arm 101, and the rotation of the holding arm 111 is stopped at the timing when the stopper mechanism 170 is operated, the regulating arm 101 is retracted to a predetermined retraction position.

In the example, the retraction position of the regulating arm 101 is set to the inner side of the side guide 32 from the vertical line connecting the center of the first rotating shaft 102 and the center of the second rotating shaft 112, and thus, the regulating arm 101 is maintained in the completely retracted state from the medium accommodating area. As a result, during the medium set operation into the accommodating portion 30, the presence of the regulating arm 101 may not be an obstacle.

A cut-out opening 115 (see FIGS. 11 and 12) is provided in the side guide 32 so that the regulating arm 101 is movable to the retraction position.

Example of Layout of Medium Regulating Component

In the example, the second rotating shaft 112 is disposed above the first rotating shaft 102, and, additionally, the first rotating shaft 102 is disposed substantially just below the second rotating shaft 112.

Then, in the example, a tip end trajectory m1 when the regulating arm 101 rotates about the second rotating shaft 112 is set to be positioned above the maximum load capacity Lmax of the media accommodated in the accommodating portion 30, and thus, even when the regulating arm 101 rotates in the downward rotating direction, the regulating arm 101 does not interfere with the media in the accommodating portion 30.

Meanwhile, a lantern trajectory m2 when the regulating arm 101 rotates about the first rotating shaft 102 is set to be positioned below the maximum load capacity Lmax of the media accommodated in the accommodating portion 30, and thus, a gap between the initial position HP of the regulating arm 101 and the maximum load capacity Lmax of the media may not be large unnecessarily, and the excessive floating of the medium works effectively by the regulating arm 101.

In the example, the second rotating shaft 112 is set above the first rotating shaft 102. However, in an example in which the second rotating shaft 112 is set below the first rotating shaft 102, interference between regulating arm 102 and the maximum load capacity Lmax of the media accommodated in the accommodating portion 30 may occur.

Second Exemplary Embodiment

Figure 17:
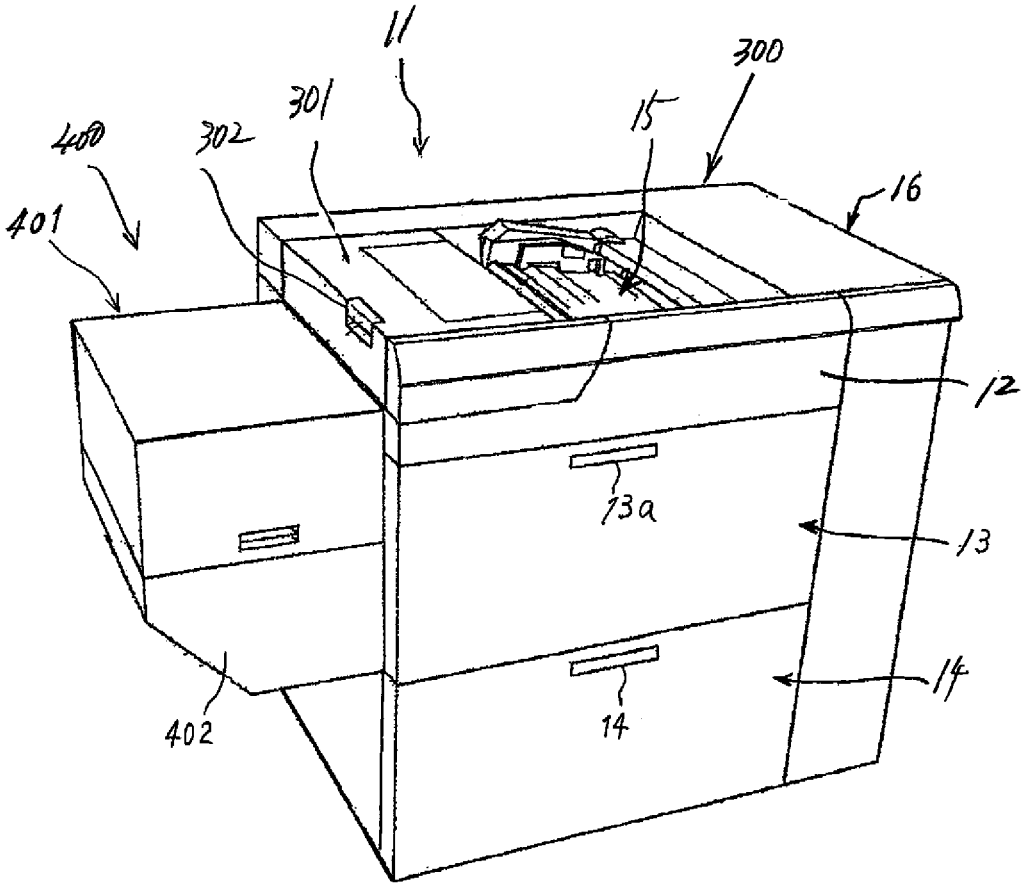
FIG. 17 is an explanatory perspective view illustrating an appearance of a medium feeding device according to a second exemplary embodiment.

FIG. 17 illustrates a main part of a medium feeding device 11 according to a second exemplary embodiment.

In the drawing, the basic configuration of the medium feeding device 11 is substantially the same as that of the first exemplary embodiment, but, unlike the first exemplary embodiment, in addition to the normal size medium, it is possible to use a long size medium having a length in the longitudinal direction longer than that of the normal size. The same configurations as those in the first exemplary embodiment are designated by the same reference numerals as those in the second exemplary embodiment, and detailed description thereof will be omitted here.

In the example, the medium feeding device 11 includes a body portion 300 (having substantially the same configuration as the medium feeding device of the first exemplary embodiment) on which normal size media are loaded and that feeds the normal size medium, and a long size option 400 is added to the body portion 300 to be able to stack and feed a long size medium.

In the example, the body portion 300 has substantially the same configuration as the medium feeding device 11 illustrated in the first exemplary embodiment. However, unlike the exemplary embodiment, the side wall positioned on the side opposite to the relay unit 16 of the case 12 is configured so that an opening to which the long size option 400 may be connected may be secured, and, additionally, an opening/closing cover 301 is provided in the location in the upper portion of the case 12 adjacent to the manual sheet feeding unit 15 so as to be openable/closable with the manual sheet feeding unit 15 side as a rotation fulcrum, and the opening/closing cover 301 is opened by operating a handle 302 provided in the opening/closing cover 301 to secure a working space when a long size medium is set.

Figure 18:
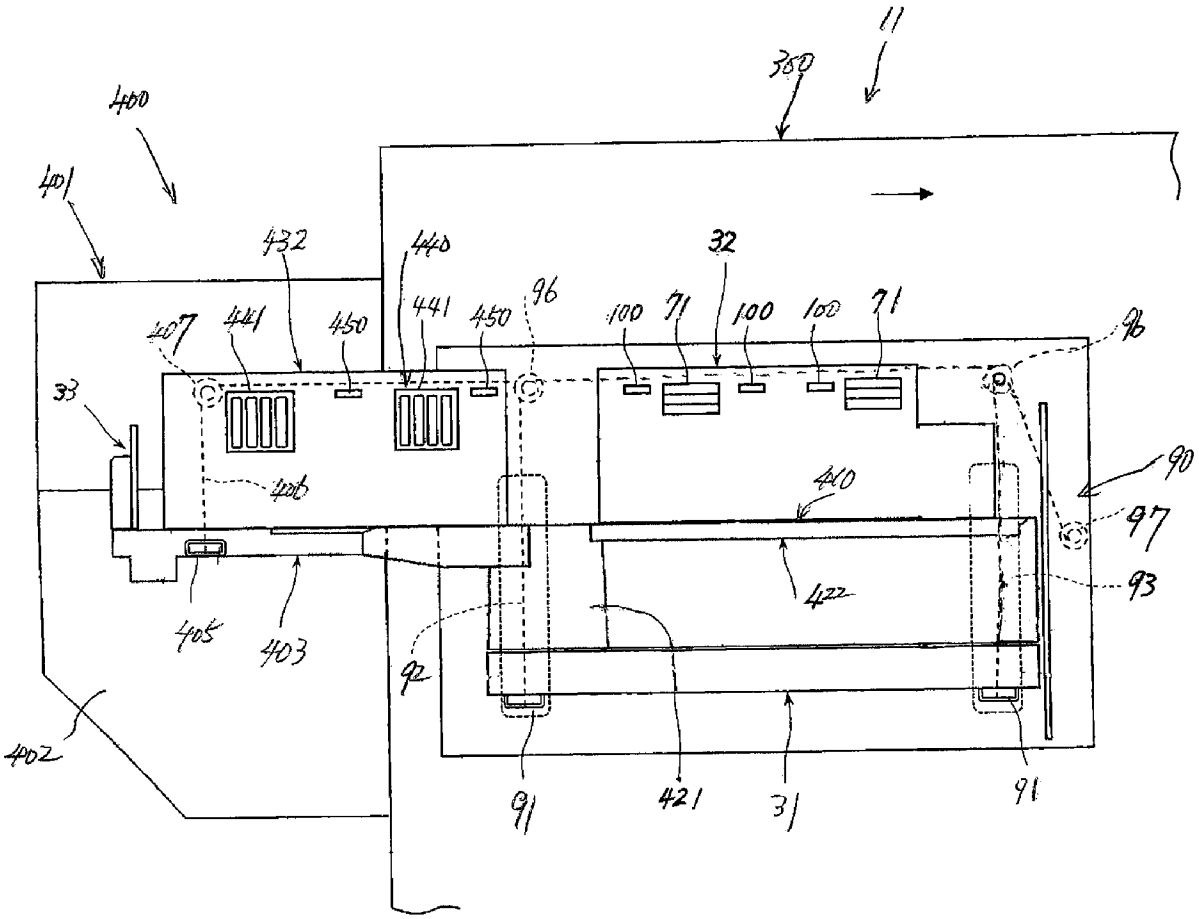
FIG. 18 is an explanatory view of a main part as viewed the main part of an internal structure of the medium feeding device illustrated in FIG. 17.
Figure 19:
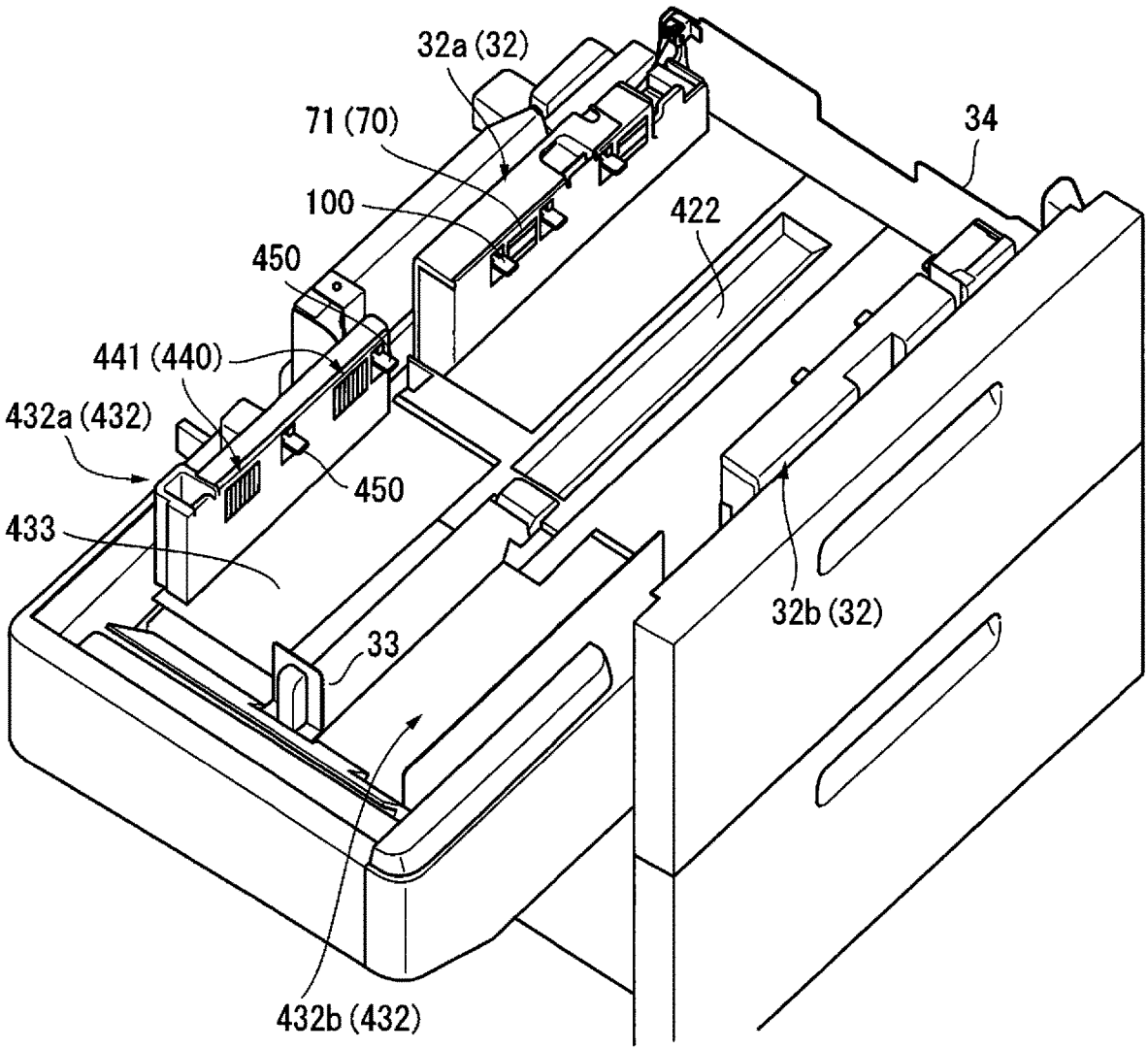
FIG. 19 is an explanatory view illustrating a main part of an accommodating portion for a long size medium in FIG. 18.

In the example, as illustrated in FIGS. 17 to 19, the long size option 400 includes an additional device 401 connected to an opening in the side wall on the side opposite to the relay unit 16 of the body portion 300, and a changing device 420 that partially change the configuration of the body portion 300 side.

In the example, in the changing device 420, a raising table 421 serving as a raising portion that raises the height is provided in the loading bottom plate 31 that constitutes a part of the accommodating portion 30 of the upper drawer 13 in the body portion 300, and the surface portion of the raising table 421 serves as a dedicated loading portion 422.

Further, in the additional device 401, an additional loading portion 403 is provided in an external attaching case 402 at a location adjacent to the side opposite to the delivery roller 40 of the dedicated loading portion 422, and the loading surface of the dedicated loading portion 422 and the loading surface of the additional loading portion 403 form substantially a surface to function as a long size loading portion 410 on which a long size medium may be loaded. Particularly, in the example, although the configuration in which the loading surface for the long size medium is raised higher than the loading surface of the normal size medium using the raising table 421 is adopted, it is intended to reduce the weight of the long size medium loaded on the long size loading portion 410 to reduce the load on the elevating mechanism 90.

Further, in the example, in addition to the configuration in which the loading bottom plate 31 is moved up and down in the first exemplary embodiment, the elevating mechanism 90 is provided with plural hanging portions 405, plural wires 406, and plural guide pulleys 407 that move the additional loading portion 403 up and down, and the additional loading portion 403 is hung on and supported by the plural wires 406, and, again, the plural wires 406 are hung on the guide pulley 96 that is the existing component of the elevating mechanism 90 on the body portion 300 side, one end side of each of the wire 406 is fixed to the winding pulley 97 that is the existing component, and the driving motor 98 that is the existing component is rotated, and thus, the additional loading portion 403 and the dedicated loading portion 422 are moved up and down at the same timing.

Further, in the external attaching case 402 of the additional device 401, additional side guides 432 (specifically 432*a* and 432*b*) that position and guide the both sides in the width direction intersecting the delivery direction of the long size medium are provided about the additional loading portion 403, and the existing end guide 33 is also used for the additional loading portion 403, and, again, the additional side guides 432 are provided with an additional levitating mechanism 440, and, additionally, an additional medium regulating component 450 that prevents the excessive floating of the side edge portion when the long size medium is levitated is provided. In FIG. 19, the reference numeral 441 indicates an air blowing port of the additional levitating mechanism 440, and the additional medium regulating component 450 is provided in the vicinity of the air blowing port 441.

As described above, in the medium feeding device 11 using the long size option 400, long size media are accommodated in the long size loading portion 410, and the surface of the long size media is disposed at the predetermined position by the elevating mechanism 90, and is waiting for a medium feeding instruction in this state.

Then, when the medium feeding instruction is issued, the levitating mechanism 70 and the additional levitating mechanism 440 are operated to implement the medium feeding operation in which the long size medium is levitated, the upper surface portion of the long size medium levitated by the vacuum head 50 on the delivery direction side is adsorbed and transported to the delivery roller 40, and then, the end portion of the delivery direction side of the long size medium is processed by the air processing mechanism 80 to transfer to the delivery roller 40.

At this time, although it is seen that the long size medium tends to be skewed more easily than the normal size medium, in the example, it is extremely effective in that it is possible to detect the state of the end portion of the delivery direction side of the long size medium and to easily determine whether the feeding state of the long size medium is in an allowable range or an abnormal range.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium regulating component for use in a medium feeding device that feeds sheet media accommodated in an accommodating unit, the medium regulating component for regulating excessive floating of a medium accommodated in the accommodating unit, the medium regulating component comprising:

a regulating member that protrudes in a horizontal direction from a periphery of the accommodating unit and that comes into contact with the floating medium;

a holding member that holds the regulating member in a non-contact state with the medium;

a first rotating shaft that supports the regulating member to be rotatable with respect to the holding member; and a second rotating shaft that supports the holding member to be rotatable with respect to the accommodating unit, wherein when the regulating member receives a pressing force from below in a gravitational direction, the regulating member rotates about the first rotating shaft in a state where movement of the holding member is suppressed, and when the regulating member receives a pressing force from above in the gravitational direction, the regulating member pushes the holding member to rotate about the second rotating shaft.

2. A medium regulating component for use in a medium feeding device that feeds a sheet media accommodated in an accommodating unit, the medium regulating component for regulating excessive floating of a medium accommodated in the accommodating unit, the medium regulating component comprising:

a regulating member that protrudes in a horizontal direction from a periphery of the accommodating unit and that comes into contact with the floating medium;

a holding member that holds the regulating member in a non-contact state with the medium;

a first rotating shaft that supports the regulating member to be rotatable with respect to the holding member;

a second rotating shaft that supports the holding member to be rotatable with respect to the accommodating unit;

a limiting unit that limits movement of the holding member when the regulating member receives a pressing force from below in a gravitational direction to rotate upward;

a restraining unit that restrains the regulating member with respect to the holding member when the regulating member receives a pressing force from above in the gravitational direction to rotate downward; and an urging unit that urges the regulating member to return to an initial position in which the regulating member protrudes in the horizontal direction when the regulating member rotates in an upward rotating direction or in a downward rotating direction from the initial position.

3. The medium regulating component according to claim 1, wherein the second rotating shaft is above the first rotating shaft.

4. The medium regulating component according to claim 2, wherein the second rotating shaft is above the first rotating shaft.

5. The medium regulating component according to claim 3, wherein the first rotating shaft is below the second rotating shaft.

6. The medium regulating component according to claim 4, wherein the first rotating shaft is below the second rotating shaft.

7. The medium regulating component according to claim 2, wherein the urging unit comprises a first urging unit around the first rotating shaft, and when the regulating member rotates in the upward rotating direction, the first urging unit urges the regulating member in a direction of returning to the initial position.

8. The medium regulating component according to claim 2, wherein the urging unit comprises a second urging unit around the second rotating shaft, and when the regulating member rotates in the downward rotating direction in a state of being restrained by the holding member, the second urging unit urges the regulating member in a direction of returning to the initial position.

9. The medium regulating component according to claim 7, wherein the urging unit comprises a second urging unit around the second rotating shaft, and when the regulating member rotates in the downward rotating direction in a state of being restrained by the holding member, the second urging unit urges the regulating member in a direction of returning to the initial position.

10. The medium regulating component according to claim 1, wherein a rotation trajectory of a protruding end of the regulating member when the regulating member rotates about the second rotating shaft is positioned above a maximum load line of the media accommodated in the accommodating unit.

11. The medium regulating component according to claim 2, wherein a rotation trajectory of a protruding end of the regulating member when the regulating member rotates about the second rotating shaft is positioned above a maximum load line of the media accommodated in the accommodating unit.

12. The medium regulating component according to claim 10, wherein a rotation trajectory of the protruding end of the regulating member when the regulating member rotates about the first rotating shaft is positioned below the maximum load line of the media accommodated in the accommodating unit.

13. The medium regulating component according to claim 2, wherein the limiting unit comprises a rotation stop portion that stops the rotation of the holding member with respect to the accommodating unit when the regulating member rotates in the upward rotating direction.

14. The medium regulating component according to claim 2, wherein the restraining unit comprises a damming portion that dams the holding member with respect to the accommodating unit when the regulating member rotates in the downward rotating direction.

15. The medium regulating component according to claim 1, wherein the regulating member is retractable to a retraction position beyond a vertical direction passing through the first rotating shaft when rotating in a downward rotating direction.

16. A medium feeding device comprising:

an accommodating unit in which sheet media are accommodated;

a delivery unit that is on a delivery direction side of the media accommodated in the accommodating unit and that delivers the media one by one;

a transfer unit that is above the accommodating unit and that transfers the media accommodated in the accommodating unit to the delivery unit; and the medium regulating component according to claim 1 that is on the periphery of the accommodating unit and that regulates the excessive floating of the medium.

17. The medium feeding device according to claim 16, further comprising:

a levitating unit that is on a side intersecting the delivery direction of the media accommodated in the accommodating unit and that blows air to the side of the medium to levitate the medium in a state where an upper area of the medium is separated, wherein the transfer unit adsorbs the medium levitated by the levitating unit and that transfers to the delivery unit.

18. The medium feeding device according to claim 17, wherein the medium regulating component is above an air blowing port of the levitating unit in a side portion of the accommodating unit.

19. The medium feeding device according to claim 16, wherein in order to accommodate long size media having a longer dimension in the delivery direction of the media than a normal length dimension, the accommodating unit comprises a standard accommodating portion that is capable of accommodating normal size media, and an extending accommodating portion that is adjacent to the standard accommodating portion and extends, and the medium regulating component is in both the standard accommodating portion and the extending accommodating portion.

20. A medium processing apparatus comprising:

the medium feeding device according to claim 16; and a processing unit that performs predetermined processing on the medium fed from the medium feeding device.

* * * * *